US007828544B2

(12) United States Patent
Di Lorenzo

(10) Patent No.: US 7,828,544 B2
(45) Date of Patent: Nov. 9, 2010

(54) CONCRETE PANEL CONSTRUCTION SYSTEM AND METHOD OF MAKING PANELS

(75) Inventor: Nick Di Lorenzo, Woodbridge (CA)

(73) Assignee: Brentmuir Developments (1993) Limited, Weston (CA)

( * ) Notice: Subject to any disclaimer, the term of this patent is extended or adjusted under 35 U.S.C. 154(b) by 900 days.

(21) Appl. No.: 11/287,264

(22) Filed: Nov. 28, 2005

(65) Prior Publication Data

US 2006/0137269 A1 Jun. 29, 2006

Related U.S. Application Data

(60) Provisional application No. 60/630,588, filed on Nov. 26, 2004.

(51) Int. Cl.
*B28B 1/26* (2006.01)

(52) U.S. Cl. ..... 425/441; 249/119; 249/120; 249/124; 249/129; 249/162; 425/234; 425/338

(58) Field of Classification Search ..... 249/119–129, 249/160–170; 425/182, 432, 441, 450, 456, 425/450.1

See application file for complete search history.

(56) References Cited

U.S. PATENT DOCUMENTS

RE21,905 E 9/1941 Nielsen
2,262,899 A 11/1941 Mechlin
2,983,983 A * 5/1961 Mayer ..... 249/129
3,232,018 A 2/1966 MacKean
3,475,529 A 10/1969 Lacy
3,683,578 A 8/1972 Zimmerman
3,780,077 A 12/1973 Dashow
3,785,603 A 1/1974 Heinzman et al.

(Continued)

FOREIGN PATENT DOCUMENTS

CA 2078381 9/1992

(Continued)

OTHER PUBLICATIONS

Weaver Precast & Florida, Inc.: "Epic Wall System".

*Primary Examiner*—Yogendra Gupta
*Assistant Examiner*—Thu Khanh T Nguyen
(74) *Attorney, Agent, or Firm*—Bereskin & Parr LLP/S.E.N.C.R.L., s.r.l.

(57) ABSTRACT

A concrete building panel has a slab and a plurality of ribs and beams. A series of horizontal holes in the end ribs are spaced at a selected constant spacing such that adjacent panels may be fastened together through them. In one type of panel, the slab is separated from the ribs to provide an air gap. Connections between holes in two adjacent concrete wall panels are made by a hollow conduit having an abutment at either end to engage the concrete wall panels. Other connections between adjacent panels involve a stitch with legs which extend through holes in the beams. Other connections involve a space made by vertical channels of horizontally adjacent panels. A plate fitted into the space aligns the adjacent panels and may extend upwards to align upper panels. Load bearing horizontal holes through the ribs are reinforced with reinforcing bar in the concrete arranged in generally triangular shapes. The concrete panels are formed vertically in a gang form. Connections between a roof panel and another roof panel or a wall panel are described.

4 Claims, 22 Drawing Sheets

U.S. PATENT DOCUMENTS

| | | | | | |
|---|---|---|---|---|---|
| 3,804,381 | A | | 4/1974 | Camus | |
| 3,844,524 | A | * | 10/1974 | Fisher et al. | 249/120 |
| 3,881,856 | A | | 5/1975 | Fougea | |
| 3,885,369 | A | | 5/1975 | Ott | |
| 4,019,293 | A | | 4/1977 | Armas | |
| 4,030,262 | A | | 6/1977 | Dean | |
| 4,067,941 | A | * | 1/1978 | Gaudelli et al. | 249/120 |
| 4,112,646 | A | | 9/1978 | Clelland | |
| 4,157,640 | A | | 6/1979 | Joannes | |
| 4,178,343 | A | | 12/1979 | Rojo, Jr. | |
| 4,182,092 | A | | 1/1980 | Weaver | |
| 4,211,043 | A | | 7/1980 | Coday | |
| 4,219,978 | A | | 9/1980 | Brown | |
| 4,320,606 | A | | 3/1982 | GangaRao | |
| 4,374,635 | A | * | 2/1983 | Carucci et al. | 425/441 |
| 4,454,702 | A | | 6/1984 | Bonilla-Lugo et al. | |
| 4,530,191 | A | | 7/1985 | Boisbluche | |
| 4,570,398 | A | | 2/1986 | Zimmerman | |
| 4,605,529 | A | | 8/1986 | Zimmerman | |
| 4,611,450 | A | | 9/1986 | Chen | |
| 4,614,013 | A | | 9/1986 | Stevenson | |
| 4,751,803 | A | | 6/1988 | Zimmerman | |
| 4,759,160 | A | | 7/1988 | Fischer | |
| 4,781,006 | A | | 11/1988 | Haynes | |
| 4,934,121 | A | | 6/1990 | Zimmerman | |
| 5,055,252 | A | | 10/1991 | Zimmerman | |
| 5,058,345 | A | | 10/1991 | Martinez | |
| 5,335,472 | A | | 8/1994 | Phillips | |
| 5,381,635 | A | | 1/1995 | Sanger | |
| 5,398,470 | A | | 3/1995 | Ritter et al. | |
| 5,433,504 | A | | 7/1995 | Kao | |
| 5,493,838 | A | | 2/1996 | Ross | |
| 5,501,055 | A | | 3/1996 | Storch et al. | |
| 5,566,520 | A | | 10/1996 | Branitzky | |
| 5,656,194 | A | | 8/1997 | Zimmerman | |
| 5,865,001 | A | | 2/1999 | Martin et al. | |
| 5,927,043 | A | | 7/1999 | Newkirk | |
| 5,953,864 | A | | 9/1999 | Beck | |
| 6,003,278 | A | | 12/1999 | Weaver et al. | |
| 6,112,489 | A | | 9/2000 | Zweig | |
| 6,151,843 | A | | 11/2000 | Weaver et al. | |
| 6,550,215 | B1 | | 4/2003 | Pulte et al. | |
| 7,182,307 | B2 | * | 2/2007 | Baker et al. | 249/120 |

FOREIGN PATENT DOCUMENTS

| | | |
|---|---|---|
| CA | 2274287 | 12/1999 |
| CH | 644300 | 7/1984 |
| DE | 20 17 109 | 11/1970 |
| DE | 22 54 174 | 5/1974 |
| DE | 29 51 898 | 7/1980 |
| DE | 34 13 305 | 10/1984 |
| EP | 0 818 287 | 1/1998 |
| FR | 483834 | 5/1917 |
| FR | 863026 | 3/1931 |
| FR | 898765 | 7/1944 |
| FR | 1422473 | 3/1966 |
| FR | 2045625 | 3/1971 |
| FR | 2163897 | 7/1973 |
| FR | 2192486 | 2/1974 |
| FR | 2 560 621 | 9/1985 |
| GB | 1 119 057 | 11/1965 |
| JP | 10252278 | 9/1998 |
| WO | WO9429090 | 12/1994 |

* cited by examiner

CONCRETE PANEL CONSTRUCTION SYSTEM AND METHOD OF MAKING PANELS

This is an application claiming the benefit under 35 USC 119(e) of U.S. Application No. 60/630,588 filed Nov. 26, 2004. U.S. Application No. 60/630,588 is incorporated herein, in its entirety, by this reference to it.

FIELD OF THE INVENTION

This document relates to construction systems using concrete panels or methods of making concrete panels.

BACKGROUND OF THE INVENTION

U.S. Pat. Nos. 4,605,529, 4,751,803 and 4,934,121 describe concrete wall panels having vertical ribs extending between horizontal upper and lower beams all attached to a concrete slab which provides the outer surface of the wall. The ribs and beams of the panels are reinforced by longitudinal reinforcing bars and the concrete slab is reinforced by a wire mesh. A "bolting saddle" cast into the ends of the upper beams allows adjacent panels to be bolted together. U.S. Pat. No. 5,656,194 describes an assembly jig having hinged sidewalls for use in making such panels.

SUMMARY

The following summary is intended to introduce the reader to the specification, but not to define the invention. One or more inventions may reside in combinations or sub-combinations of one or more apparatus elements or process steps described in this or other parts of this documents, for example the detailed description or claims.

A concrete building panel may have a slab and a plurality of ribs and beams. The ribs may include interior ribs and end ribs which are generally perpendicular to the slab and oriented vertically in an installed panel. The beams may include an upper and lower beam which are generally perpendicular to the slab and oriented horizontally in an installed panel. The ribs or beams or both may have holes to allow attaching adjacent panels or other structures to a panel. The ribs may be reinforced with reinforcing bar in the concrete arranged in generally triangular shapes or trusses in the plane of the rib. Load bearing holes through the ribs may be located such that apexes of the triangularly shaped reinforcement are located between the perimeter of the hole and the distal edge of the rib relative to the slab.

The concrete panels may be made by providing a form having edges which defines the perimeter of the panel, optionally but for one edge of the panel, and sides which define the front and back faces of the panel, including the ribs. The form may be made in two or more parts, and oriented vertically. The two or more parts may be separated by moving them apart generally horizontally. One or more sets of holes may be made through two opposed vertical edges of the form, a side of the form, or both the edges and a side of the form. Each set of holes is concentric when the form is closed. Rods are placed through the holes before pouring concrete into the form to form the slab and the ribs. The rods produce holes in the ribs. Reinforcing members may be pre-assembled into a basket, optionally comprising wire mesh for the slab and reinforcing bar trusses for the ribs, and placed in the form before pouring the concrete. The basket may be held in place by hangers, supports or the rods. Multiple forms may be used together. A leaf in a multiple form assembly may comprise a form for the front of one panel and the back of another panel. Leaves may be moved together or apart by a machine, for example a hydraulic arm. The machine may act directly on one leaf which may in turn act on other leaves by pushing on them or pulling on them through a tension member, for example a chain or cable.

The panels may be used as wall or roof panels. Roof panels may be attached to wall panels or other roof panels through a connector adapted to be fastened to a rib of a panel. Roof panels may also bear on or be attached to a ridge beam.

DETAILED DESCRIPTION

Various apparatuses or processes will be described below including an example of an embodiment of each claimed invention although any claimed invention may cover processes or apparatuses that are not described below. The claimed inventions are not limited to apparatuses or processes having all of the features of any one apparatus or process described below or to features common to multiple or all of the apparatuses or processes described below. It is possible that an apparatus or process described below is not an embodiment of any claimed invention. All rights are reserved in any invention disclosed in an apparatus or process that is not claimed in this document. Any one or more features of any one or more embodiments can be combined with any one or more features of any one or more other embodiments.

Figure 1:
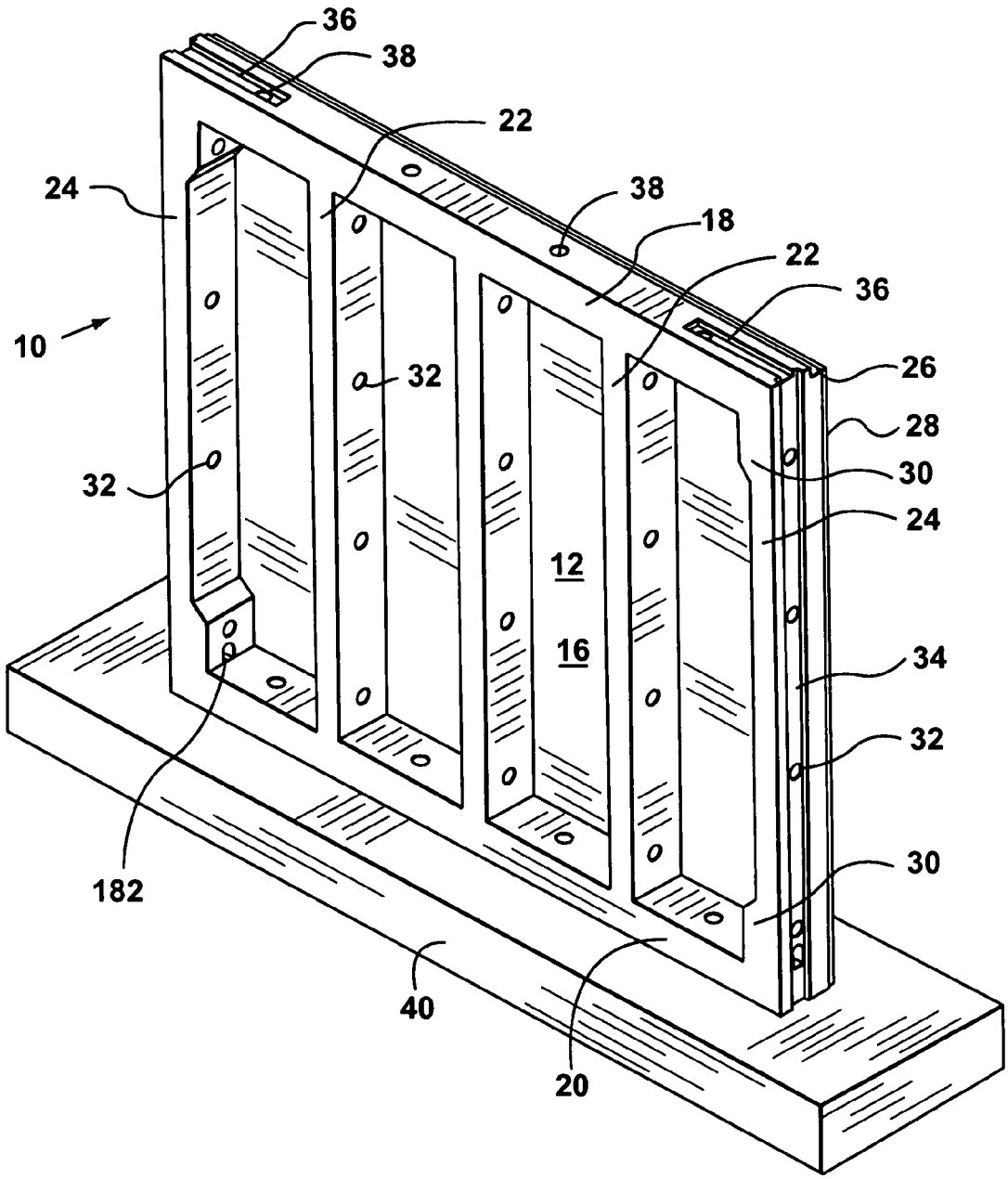
FIG. 1 is a perspective view of a first panel.

FIG. 1 shows a first panel 10 which is particularly useful for constructing basement walls but may alternately be used, for example, for other walls, roofs or floors. The first panel 10 comprises a slab 12 having an outside face 14 and an inside face 16. The slab 22 may be, for example, one and a half to three (38-76 mm) inches thick. The outside face 14 of the panel 10 may be installed so that is also the outside face of a wall. The outside face 14 may be finished with a variety of architectural finishes or treatments such that the first panel 10 is both aesthetic and structural. Alternatively, however, the outside face 14 may be made to be the inside of a wall.

The slab 12 is integrally connected to a top beam 18 and bottom beam 20 which extend from the inside face 16 of the slab 12. Beams 18, 20 are generally perpendicular to the slab 12 and are generally horizontal in an installed first panel 10. Beams 18, 20 may be, for example, about 2.5 inches (64 mm) thick, the thickness varying with their expected loading. The slab 12 and beams 18, 20 are integrally connected to interior ribs 22 and end ribs 24 which also extend from the inside face 16 of the slab 12. Ribs 22, 24 have side surfaces extending from and generally perpendicular to the slab 12 and are generally vertical in an installed first panel 10. Interior ribs 22 have centerlines extending along their length midway between side surfaces and may be spaced apart at a spacing interval to conveniently accommodate the attachment of whole sheets of common sheet materials, such as drywall or plywood, having standard length and width dimensions. End ribs 24 have distal side surfaces and may be spaced so that centerlines of interior ribs and distal side surfaces of adjacent end ribs 24 are spaced apart at the spacing interval. The spacing interval may be, for example, 24, 19.2 or 16 inches (619, 488 or 406 mm) as appropriate for use with sheeting or insulating materials. The ribs 22, 24 may range, for example, from 1.5 to 2.5 (38-64 mm) inches in thickness depending on their expected loading.

The length of the first panel 10 is variable but may be limited by the equipment available to physically handle the first panel 10. For house construction, a standard first panel 10 may be eight feet (244 cm) wide. For commercial or industrial construction or in housing projects where heavier cranes are likely available, standard first panels 10 may be, for example, 12 or 16 feet (366 or 488 cm) long. The height of a first panel 10 may also vary from a height of, for example, eight feet (244 cm) to ten feet (305 cm) or more for buildings with high ceilings. The width of a first panel 10 may be, for example, ten inches (254 mm) for residential basements but may vary for particular applications.

The upper surface of the top beam 18 may have a major rabbet 26 opening to the outside face 14 of the first panel 10. The major rabbet 26 may be, for example about 3.5 inches (89 mm) wide and 1.5 inches (38 mm) deep. The major rabbet 26 may receive the exterior sheathing or finish material of an adjacent upper wall structure. The first panel 10 may also be surrounded by a minor rabbet 28 opening to the outside face 14 of the first panel 10. This minor rabbet 28 may be, for example, about ⅛ inch (3 mm) deep and provides a recess to receive a cord and caulking. The cord and caulking help keep water out of the joint between a first panel 10 and adjacent first panels 10 or other building elements. With the minor rabbet 28, adjacent panels 10 can be butted directly against each other.

The tops and bottoms of the end ribs 24 may include a widened portion 30 extending into the beams 18, 20. This widened portion 30 provides space for increased interior metal reinforcement as well as more concrete to strengthen the corners of the first panel 10.

The ribs 22, 24 are each provided with an equal number of horizontal holes 32 located at substantially the same elevations. These horizontal holes 32 may have an appreciable diameter, for example about two and one eighth inches (54 mm). As will be discussed further below, the horizontal holes 32 are used to attach a first panel 10 to an adjacent structure. At least one horizontal hole 32 may extend through each widened portion 30. The horizontal holes 32 also provide space to run electrical wiring or plumbing etc. through first panels 10.

The end ribs 24 may have vertical channels 34 in their outer sides preferably extending along their entire length. The vertical channels 34 may cross the faces of the horizontal holes 32. The vertical channels 34 may be, for example, about ¼ inch (6 mm) deep and four inches (104 mm) wide. The vertical channels 34 may continue into horizontal channels 36 in the upper surfaces of the top beam 18 and, optionally, the lower surfaces of the bottom beam 20. The horizontal channels 36 are typically narrower than the vertical channels 34. The horizontal channels 36 extend from the vertical channels 34 to a proximal vertical hole 38.

Other vertical holes 38 may also be provided in the beams 18, 20. These vertical holes 38 may be of the same size as the horizontal holes 32 and serve a similar purpose. An exception, however, is vertical holes 38 in a beam 18, 20 that do not intersect a horizontal channel 36 and are not used to provide a conduit for services. Such vertical holes 38 may be of a smaller diameter and may be located on different spacings. Vertical holes 38 may be used to attach a first panel 10 to a foundation or another building element.

Figure 2:
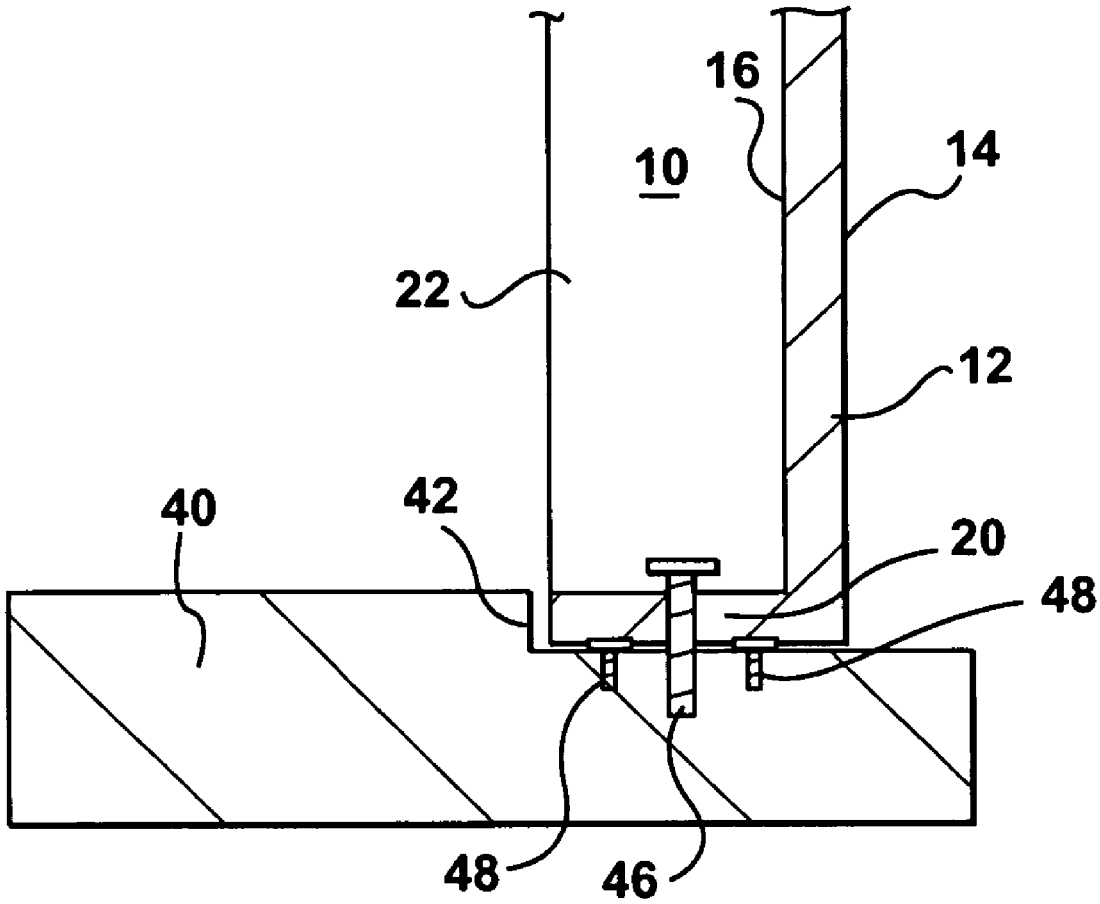
FIG. 2 is a cross section of a connection between a panel and a footing.

The first panel 10 may rest on a footing 40. FIG. 2 shows an example of a connection between a first panel 10 and a footing 40. In FIG. 2, a step 42 is provided in the footing 40 to help locate the first panel 10 relative to the footing 40. Foundation bolts 46 run through vertical holes 38 of the bottom beam 20 and are threaded, grouted or epoxied into the foundation 40. Optionally, the footing 40 may be provided pairs of levelling buttons 48, typically two pairs per panel, which project from the footing 40. The upper surface of the levelling buttons 48 is set at a selected elevation by screwing the levelling buttons 48 into or out of nuts cast into or attached onto the foundation 40. The upper surface of the levelling buttons 48 helps ensure that each first panel 10 is installed horizontally and that adjacent first panels 10 are at the same elevation despite an uneven foundation 40. The levelling buttons 48 also prevent an excess of mortar between the foundation 40 and the first panel 10 from being squeezed out of that joint.

Figure 3:
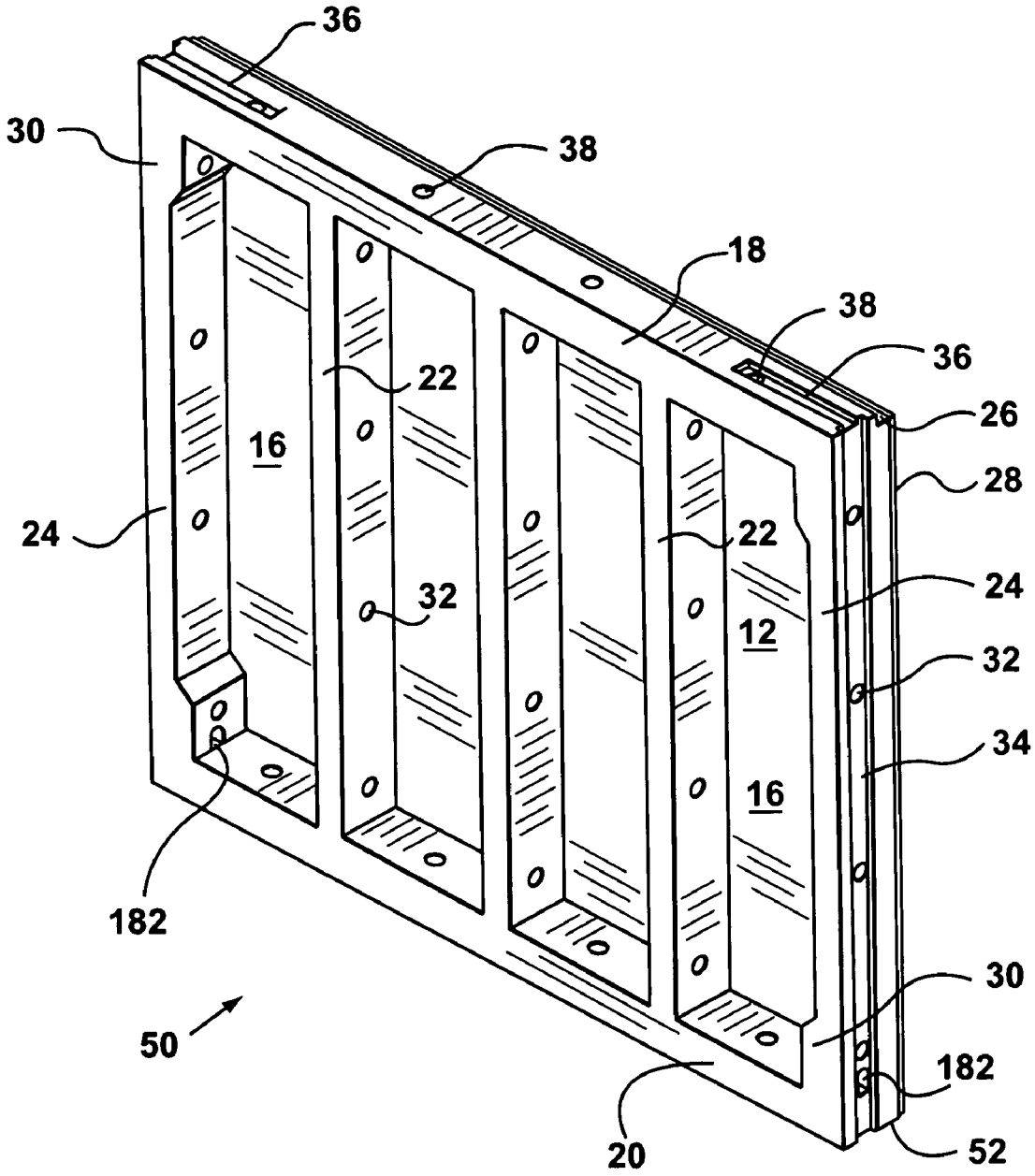
FIG. 3 is a perspective view of a second panel.

FIG. 3 shows a second panel 50 which may be used for constructing above grade walls or other purposes. The second panel 50 is similar to the first panel 10. The description and reference numerals used for the first panel 10 apply to the second panel 50 except as will be described below. Further, parts of the description of the first panel 10 which implicitly do not relate to an above grade panel, such as the attachment of the first panel 10 to a foundation, do not apply to the second panel 50.

Figure 11:
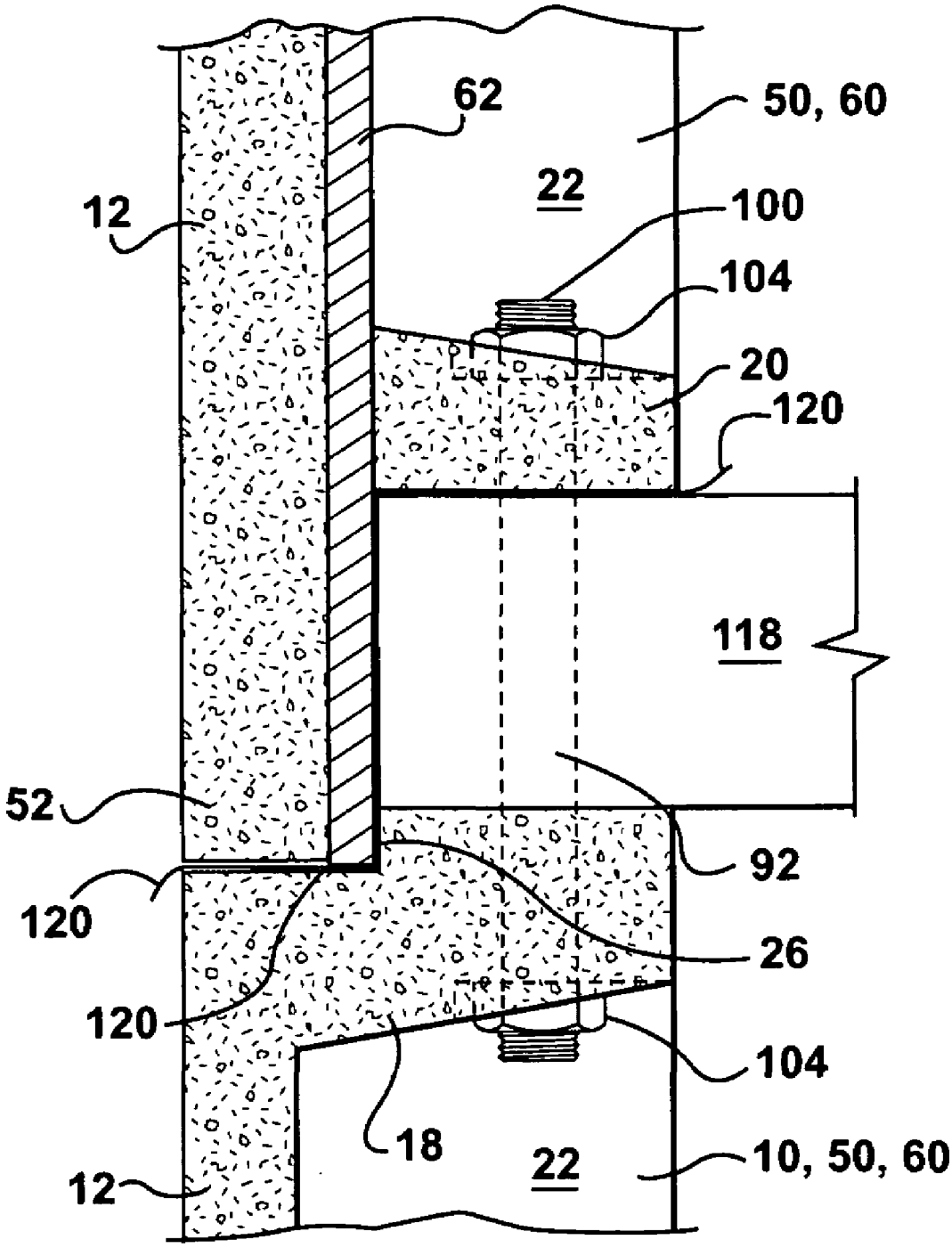
FIG. 11 is a cross section of a bolted vertical connection between panels and a floor deck.

In general, the second panel 50 may be sized and reinforced unlike the first panel 10 as required by the loading on an above grade wall as compared to a basement wall. The bottom beam 20 may be made wider than required for strength, however, to distribute the weight of the second panel 50 particularly when a second panel 50 will be installed on a wood floor deck. The second panel 50 also has an extension 52 which protrudes from the lower surface of the bottom beam 20 extending the outside face 14 of the second panel 50 downwards. This extension 52 is sized to fit into the major rabbet 26 of a lower first panel 10 or second panel 50. Where a floor deck is mounted on the lower first panel 10 or second panel 50, the extension 52 is longer than shown in FIG. 3 as required as shown in FIG. 11.

Figure 4:
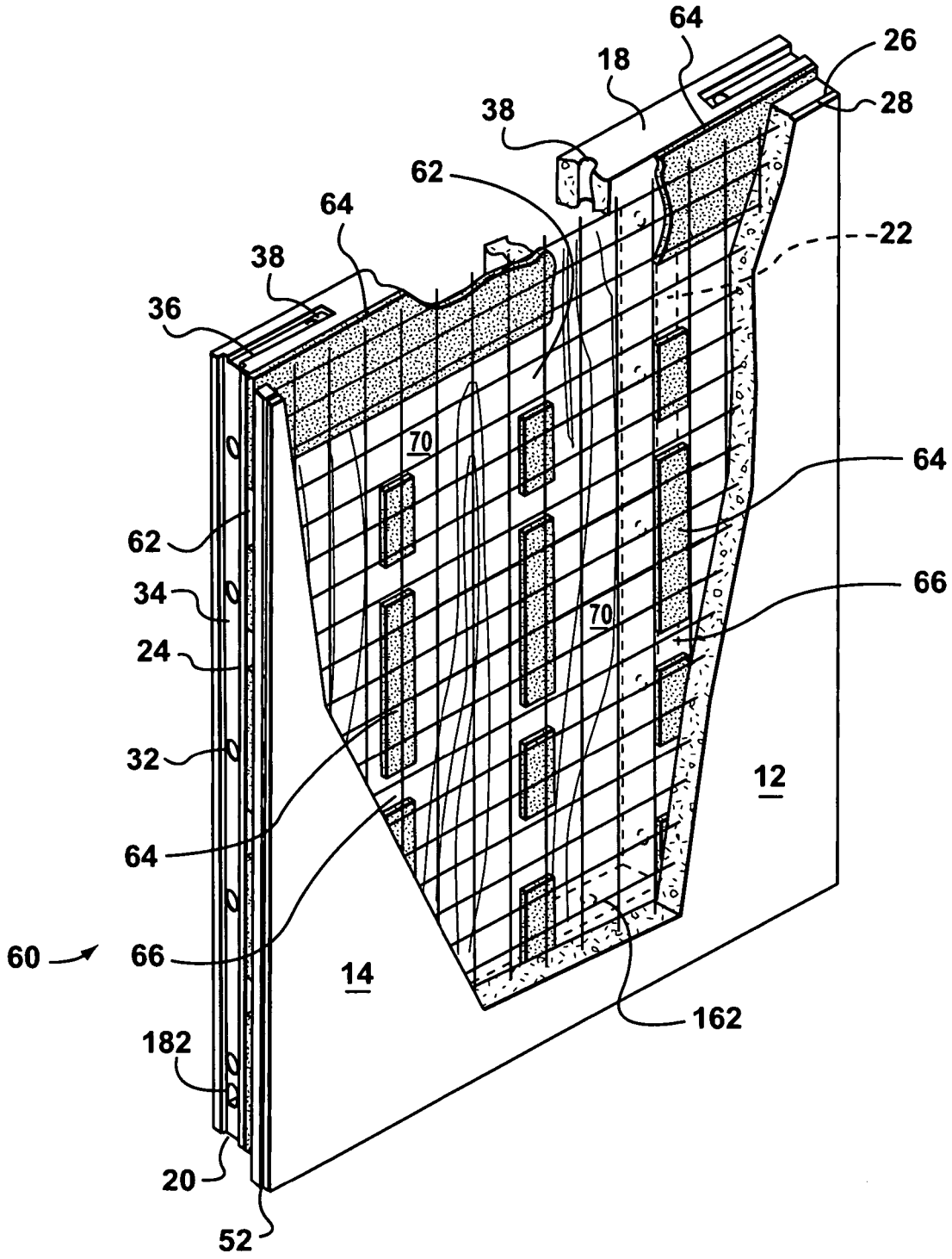
FIGS. 4 and 5 are perspective and partial cross sectional views respectively of a third panel.
Figure 5:
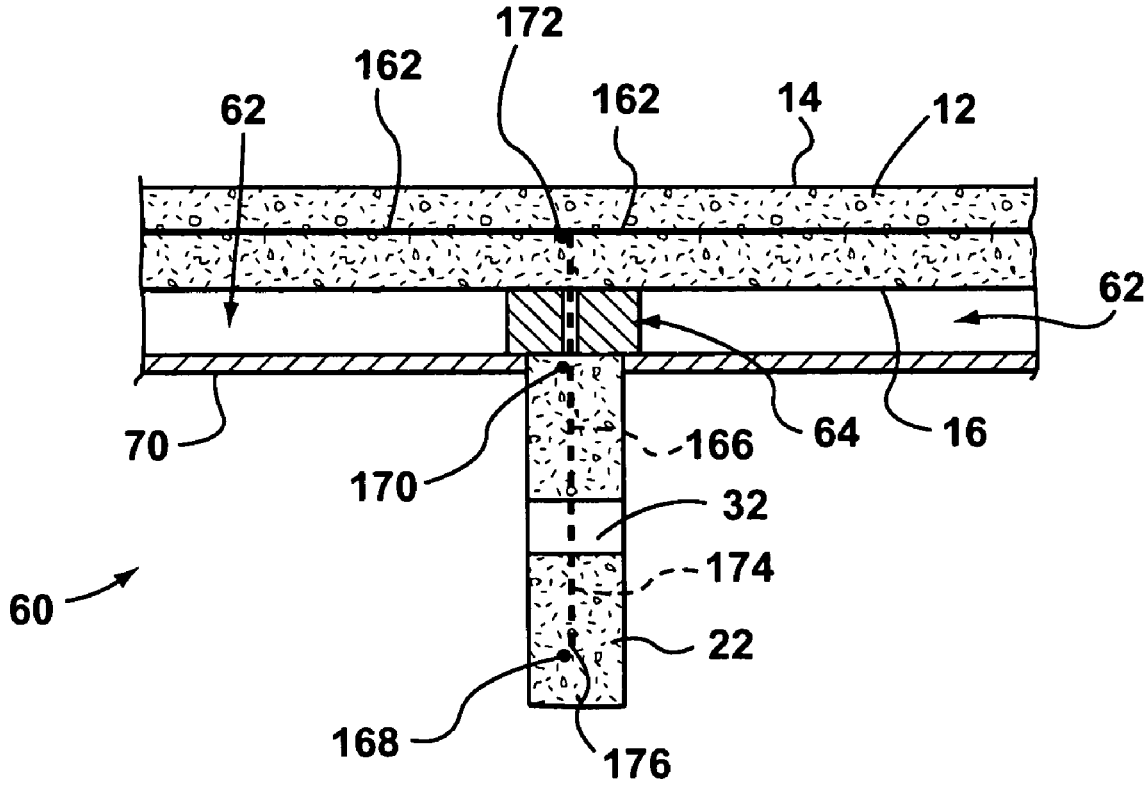

FIGS. 4 and 5 show a third panel 60 which may also be useful for constructing above grade walls or for other uses. The third panel 60 is similar to the first panel 10 and second panel 50 and the description and reference numerals above applies generally to the third panel 60 except as will be described below. As for the second panel 50, parts of the description of the first panel 10 which do not relate to an above grade panel do not apply to the third panel 60.

The third panel 60 has an air gap 62 between the slab 12 and the beams 18, 20 and ribs 22, 24. The air gap 62 acts as a thermal break, a capillary break and as a channel to allow water or water vapour to flow out of the wall. The beams 18, 20 and ribs 22, 24 are spaced from the slab 12 by insulating blocks 64 which are arranged or drilled to provide passages across ribs 22, 24 (including ribs of adjacent third panels 60) and, in some applications, across beams 18, 20 (not illustrated). The insulating blocks 64 may be a composite of polyethylene and cellulose or wood flour which is non-rusting, insulating and strong in compression such as POLYBOARD™, sold by Renew Resources of Toronto, Ontario, Canada.

The beams 18, 20 and ribs 22, 24 are connected to the slab 12 by metal reinforcement which will be described further below. The insulating blocks 64 preferably surround any metal reinforcement crossing the air gap 62 to inhibit condensation and rusting. Optionally, reinforcement that crosses the air gap 62 can be treated to prevent rusting, for example, by coating it with epoxy. Inner sheets 70, typically plywood or oriented strand board, extend between adjacent insulating blocks 64. The inner sheets 70 keep insulation placed between ribs 22, 24 out of the air gap 62 and may also support vapour or water barriers as required. The structure of the third panel 60 thus resembles many of the feature of a conventional stud wall with masonry facing.

Like the second panel 50, the third panel 60 has an extension 52 which protrudes from the lower surface of the bottom beam 20 and extends the outside face 14 of the third panel 60 downwards. The extension 52 of the third panel 60 is similarly sized to fit into the major rabbet 26 of a lower first panel 10 or second panel 50 but the extension 52 is not as thick as a major rabbet 26 so that the air gap 62 will be in fluid communication with a major rabbet 26.

The description of the panels 10, 50, 60 above relates primarily to standard sized panels. Since most buildings are not sized as even multiples of the width of standard panels 10, 50, 60, custom panels are made as required by making suitable modifications to the description above. Modified panels may also be made for corners. Alternately, corners may be made by attaching panels 10, 50, 60 together through steel or concrete brackets, for example an "L" shaped channel, attached to an end rib 24, or face 16, of adjacent panels or by bolting a rib 24 of one panel 10, 50, 60 to the face 16 of another.

Figure 6:
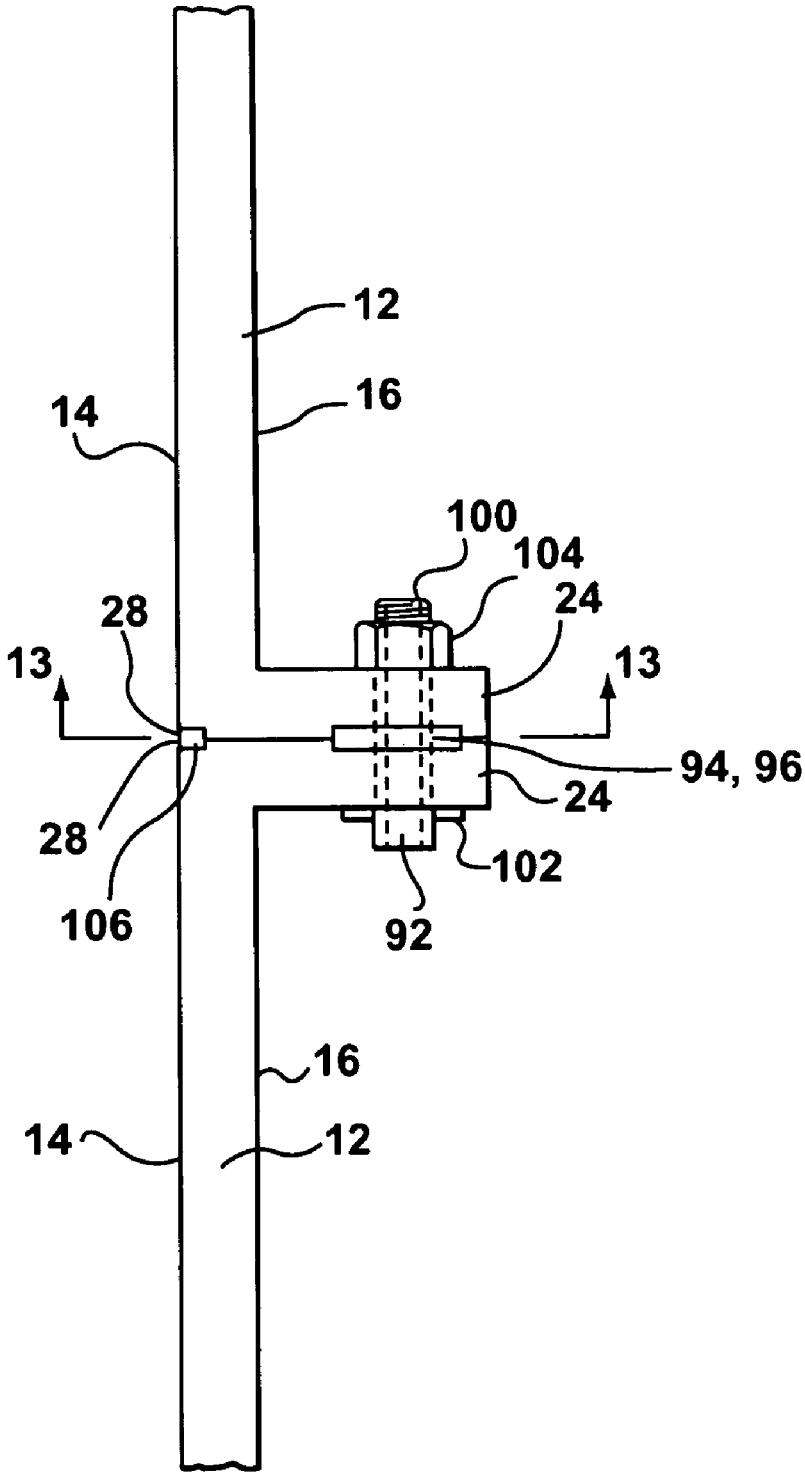
FIG. 6 is a plan view of a bolted connection between panels.
Figure 7:
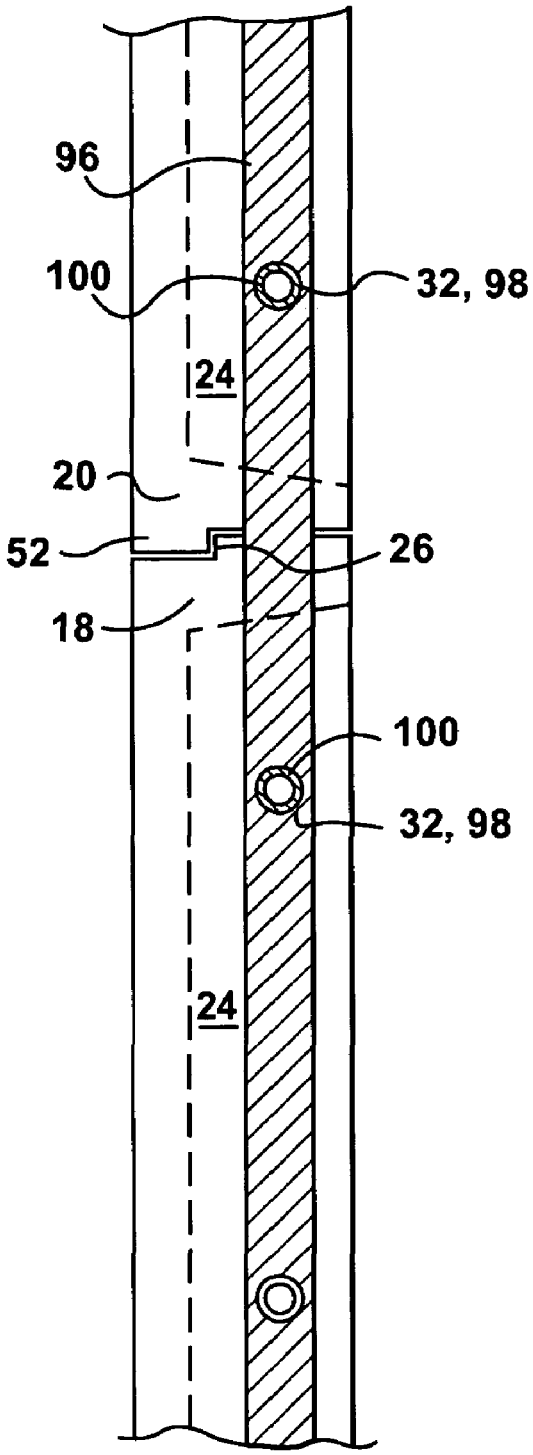
FIG. 7 is a cross section of a vertical plated connection between panels.

FIGS. 6 and 7 show a connection between adjacent panels 10, 50, 60. When two panels 10, 50, 60 are placed side by side, their horizontal holes 32 align to create continuous passages between their end ribs 24. Their vertical channels 34 also create a slot 94 capable of receiving a plate 96, typically made of steel, having plate holes 98 spaced at the nominal spacing of the horizontal holes 32. The plate 96, typically about four inches (102 mm) by one half inch (13 mm) in section but slightly smaller than the slot 94, is inserted from above the panels 10, 50, 60 to generally fill slot 94 and hold the panels 10, 50, 60 in alignment with each other. In FIG. 7, the plate 96 also extends upwards to align and attach vertically adjacent panels 50, 60. Preferably such a plate 96 extends into each panel 10, 50, 60 by at least four feet. As shown in FIG. 6, caulking 106 seals the space left by the minor rabbets 28.

The connection is completed by inserting pipe bolts 92 through the horizontal holes 32 and plate holes 98 and tightening them. Typically, a pipe bolt 92 is fastened through each horizontal hole 32 of adjacent end ribs 24 and optionally through each vertical hole 38 of vertically adjacent beams 18, 20 (not illustrated). The pipe bolts 92 consist of a section of hollow pipe 100, typically steel, of about two inches in outside diameter. The horizontal holes 32 are preferably slightly larger in diameter (ie. by about one eight of an inch) than the pipe 100 to permit a small amount of adjustment between panels 10, 50, 60 or to compensate for slight misalignment of the panels 10, 50, 60.

The pipe 100 is drilled to receive a pin 102 at one end and threaded on its other end to receive a nut 104. Alternatively, the pipe 100 may be threaded on both ends and have two nuts 104. In either event, tightening at least one nut 104 draws adjacent panels 10, 50, 60 together. Because the pipes 100 are hollow, however, wire or conduits can still be passed through horizontal holes 32 or vertical holes 38. The pipe 100 also presents more surface area in contact with the end ribs 24 than would a typical bolt and thus reduces the possibility the a force applied between the pipe 100 and an end rib 24 or beam 18, 20 crushes the concrete around a hole 32, 38.

Figure 8:
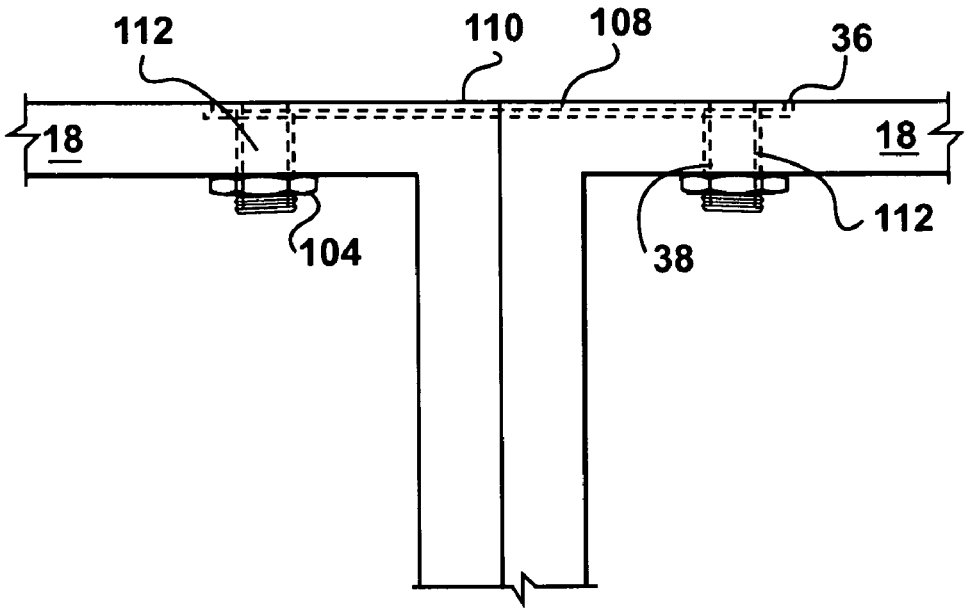
FIGS. 8, 9 and 10 are an elevational view of a stitched connection, an elevational view of a stitch and a plan view of a stitched connection respectively.
Figure 9:
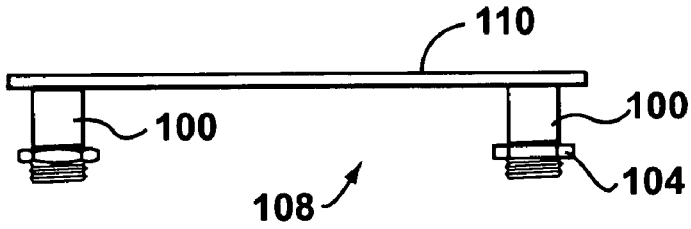
Figure 10:
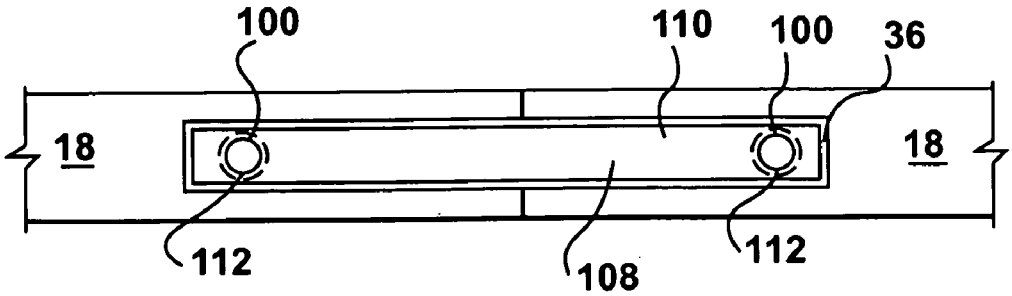

In addition to or in place of the plate 96, a stitch 108 can be used to attach horizontally adjacent panels 10, 50, 60. As shown in FIGS. 8, 9 and 10, the stitch 108 has an upper member 110, typically plate steel, and two extending legs 112, typically made of the same hollow threaded pipe of the pipe bolts 92. The legs 112 may be welded, bolted or threaded to the upper member 110. The upper member 110 may close the opening in the legs 112 or be holed so that wires or conduits can pass through the stitch 108.

The upper member 110 of the stitch 108 fits into the horizontal channels 36 of adjacent panels 10, 50, 60. The legs 112 extend through vertical holes 38 in the beams 18, 20. Stitch nuts 114 are then threaded onto the legs 112 and tightened. Depending on the application, stitches 108 may be used on the bottom beams 20, top beams 18 or both of adjacent panels 10, 50, 60.

When a stitch 108 is used without a plate 96, the stitch 108 performs the function of keeping panels 10, 50, 60 aligned while pipe bolts 92 are being fastened. This allows, as an alternative to the arrangement shown in FIG. 7, the vertical seems between plates 10, 50, 60 of one floor of a building to be staggered relative to the vertical seems between plates 10, 50, 60 of a vertically adjacent floor. When a stitch 108 is used with a plate 96, a slot is made in the plate 96 to accommodate the stitch 108. The slot is made of sufficient size and shape to allow one side of the stitch 108 (and its leg 112) to pass through the slot and to allow the stitch 108 to move upwards or downwards as required to slide the legs 112 into vertical holes 38. Alternatively or additionally, a connection between four panels 10, 50, 60 can be made by placing a stitch 108 with longer legs 112 on top of the bottom beam 20 of two horizontally adjacent panels 50, 60. The legs 112 pass through vertical holes 38 of the two horizontally adjacent panels 50, 60 and though the vertical holes 38 of another two horizontally adjacent panels 10, 50, 60 located directly below the first two horizontally adjacent panels 50, 60. A stitch access hole 182 (as shown in FIG. 3 for example) is provided in the sides of end ribs 24 just above the tops of bottom beams 20 to accommodate such a stitch 108 passing between two horizontally adjacent panels 10, 50, 60.

FIG. 11 shows an alternate or additional connection between vertically adjacent panels 10, 50, 60 using pipe bolts 92 between the end ribs 24. A conventional floor deck 118 is inserted between a lower panel 10, 50, 60 and an upper panel 50, 60. Plastic sheet 120 extends from outside the major rabbet 26 of the lower panel 10, 50, 60, upwards along the end of the floor deck 118 and along the top of the floor deck 118 to the interior of the wall. Where utilities do not need to pass between vertically adjacent panels 10, 50, 60, the pipe bolts 92 may be replaced with regular bolts. Optionally, a plate 96, as shown in FIG. 7, may be used at the ends of the panels 50, 60 with the plate holes 98 positioned to account for the floor deck 118. The floor deck 118 may be notched or cast in place to provide clearance for the plate 96.

The connections of FIGS. 7 and 11 may be combined. In either of the vertical connections of FIG. 7 or 11, the lower edge of the extension 52 of the upper panels 10, 50, 60 has drainage holes, preferably on about four foot centres. The drainage holes are typically about ¼ inch (6 mm) in diameter and permit water trapped in the joint between vertically adjacent panels 10, 50, 60 or running down through an air gap 62 to leave the wall. The plastic sheet 120 of FIG. 11 is typically also used in the connection of FIG. 7.

Figure 12:
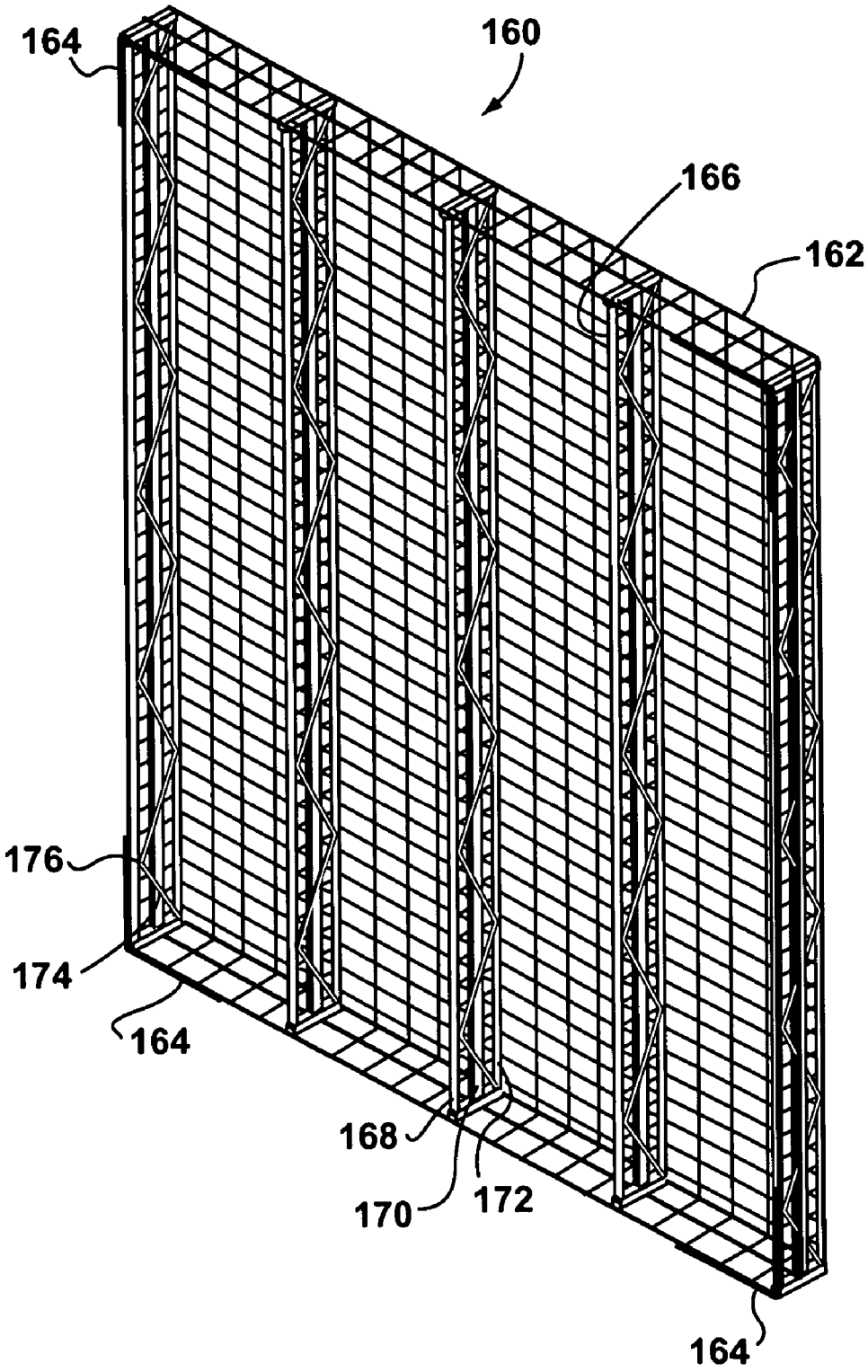
FIG. 12 is a perspective view of a basket of reinforcing material for a third panel.
Figure 16:
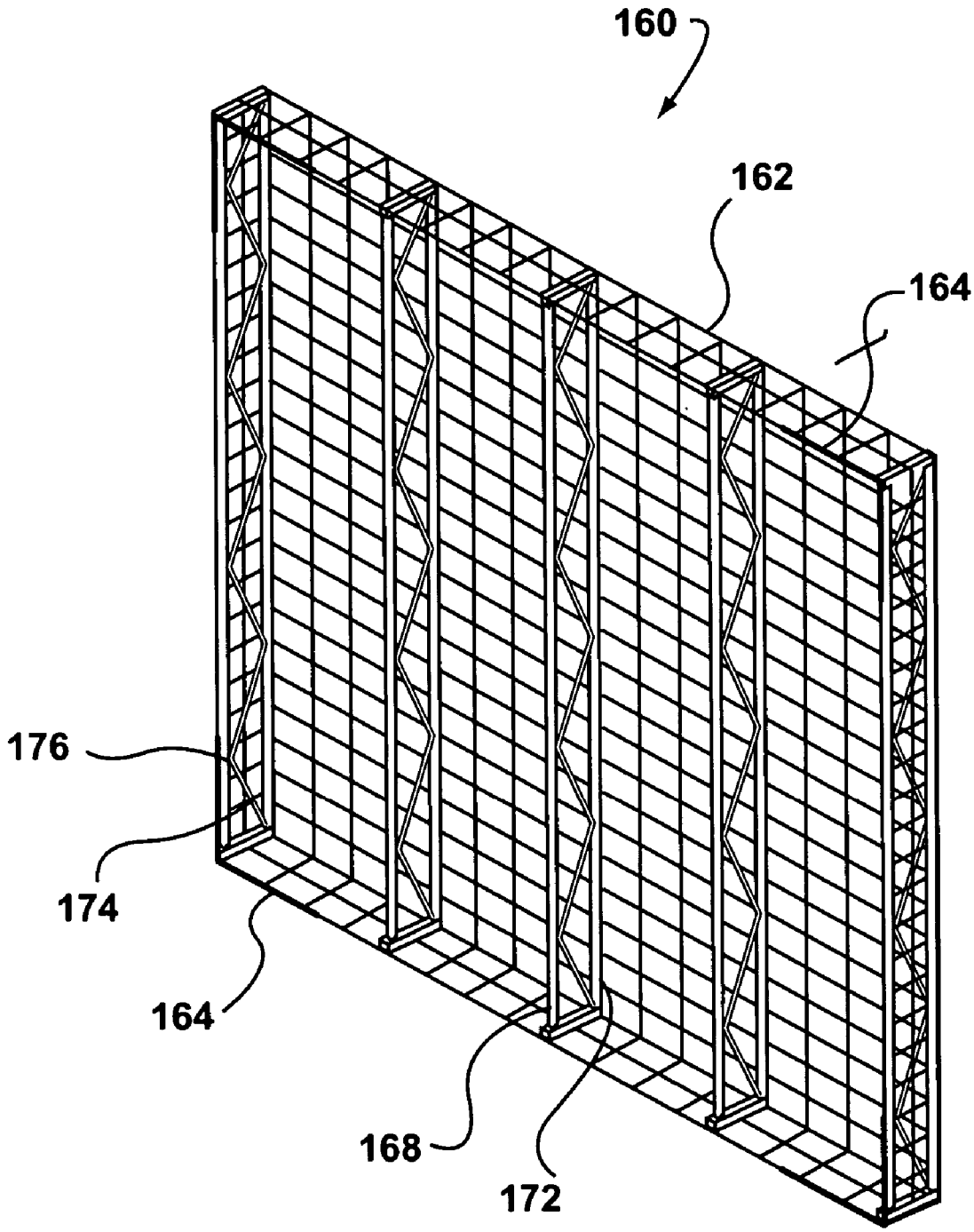
FIG. 16 is a perspective view of a basket of reinforcing material for a first or second panel.

Panels 10, 50, 60 may be reinforced. This reinforcing may be pre-formed in a basket 160 as shown in FIGS. 12 and 16. FIG. 12 shows a basket 160 for an eight foot by ten foot third panel 60. FIG. 16 shows a basket for an eight foot square first or second panel 10, 50. The baskets 160 include a wire mesh 162 sized as required to reinforce the slab 12. The wire mesh 162 is bent upwards on all four sides to also provide reinforcement for the beams 18, 20 and end ribs 24. The corners of the basket 160 are reinforced by stiffening bars 164 as shown. Trusses 166 are provided to reinforce the ribs 22, 24 and located appropriately. Tie wires secure the various components of the basket 160 together. The basket is inserted into the form 132 prior to installing the sub-forms 142 or rods 146 or pouring any concrete. The basket is shimmed as required to locate is within the form 132.

Figure 13:
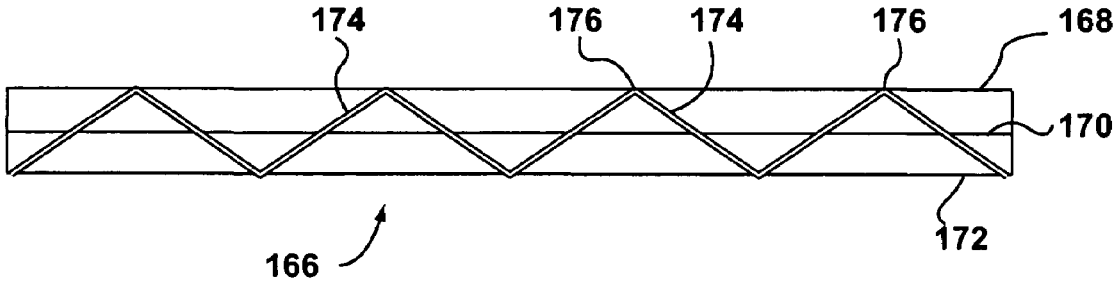
FIGS. 13, 14 and 15 are a reinforcing truss, a reinforcing truss installed in a rib of a first or second panel and a reinforcing truss installed in a rib of a third panel respectively.
Figure 15:
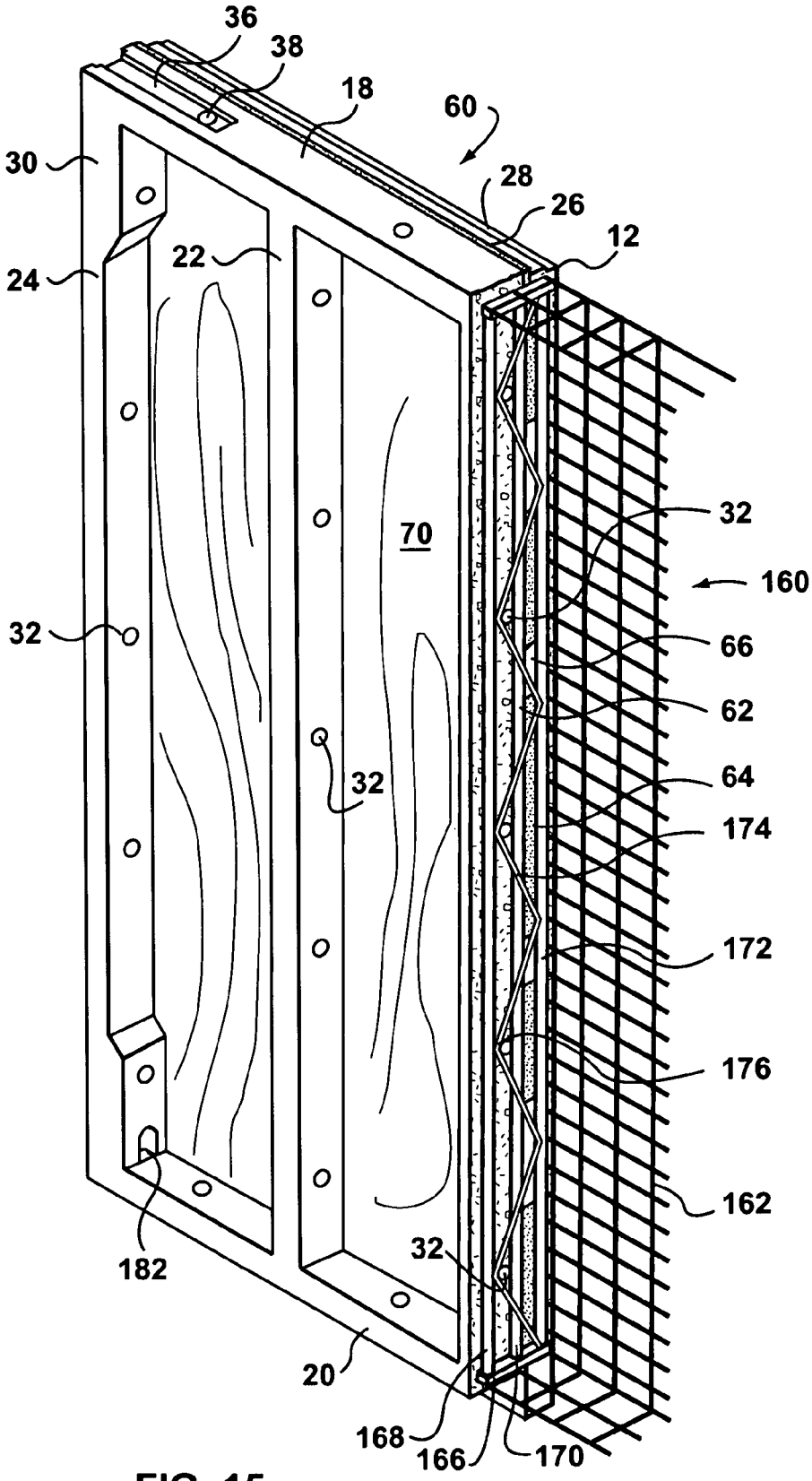

FIG. 13 shows a truss 166 for a third panel 60 in greater detail. The truss 166 has an upper cord 168, a mid cord 170 and a lower cord 172. Trusses for first and second panels 10, 50 are similar but the mid cord 170 may be omitted, as shown in FIG. 16. The lower cord 172 of the truss 166 is tied to the mesh 162 and accordingly is located in the slab 12 of a finished panel 10, 50, 60. The mid cord 170 and upper cord 168 are located in the ribs 22, 24 of a finished panel 10, 50, 60. In particular, as shown in FIGS. 5 and 15, the lower cord 168 or mid cord 170 and upper cord 172 contain the horizontal holes 32. In the third panel 60, the mid cord 170 is located outside of the air gap 62.

Figure 14:
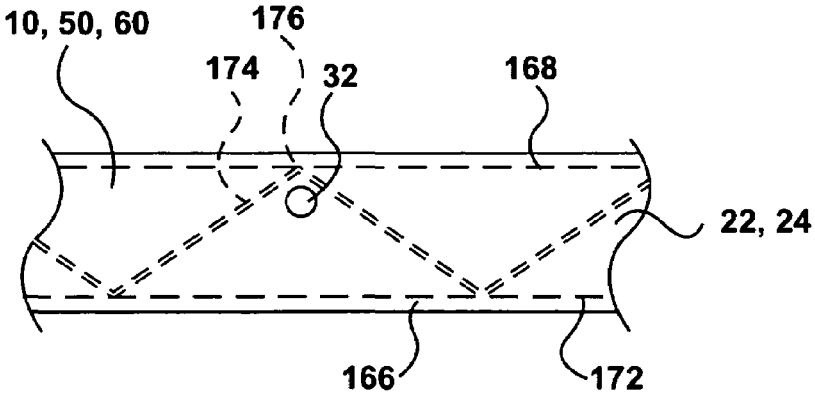

Diagonals 174 run across the cords 168, 170, 172 and are welded to them. Although the diagonals 174 may be distinct pieces, several diagonals 174 are typically made simultaneously by bending a piece of steel as required. The intersections 176 of the diagonals 174 at the upper cord 168 are spaced as described for the horizontal holes 32. Thus, as shown in FIGS. 14 and 15, the diagonals 174 further contain or surround the horizontal holes 32. This significantly reinforces the horizontal holes 32 and assists in making them strong enough to join adjacent panels 10, 50, 60 together or to support floors or shelves on a pipe passing through holes 32. As shown in FIG. 15, the diagonals 174 of a third panel 60 also provide rigid, triangulated support for the slab 12 which assists in supporting the weight of the slab 12.

Referring now to FIGS. 17-24, a forming apparatus 202 for making concrete panels 10, 50, 60 has exterior and interior forms 210, 212 that are oriented generally vertically when receiving poured concrete.

Figure 17:
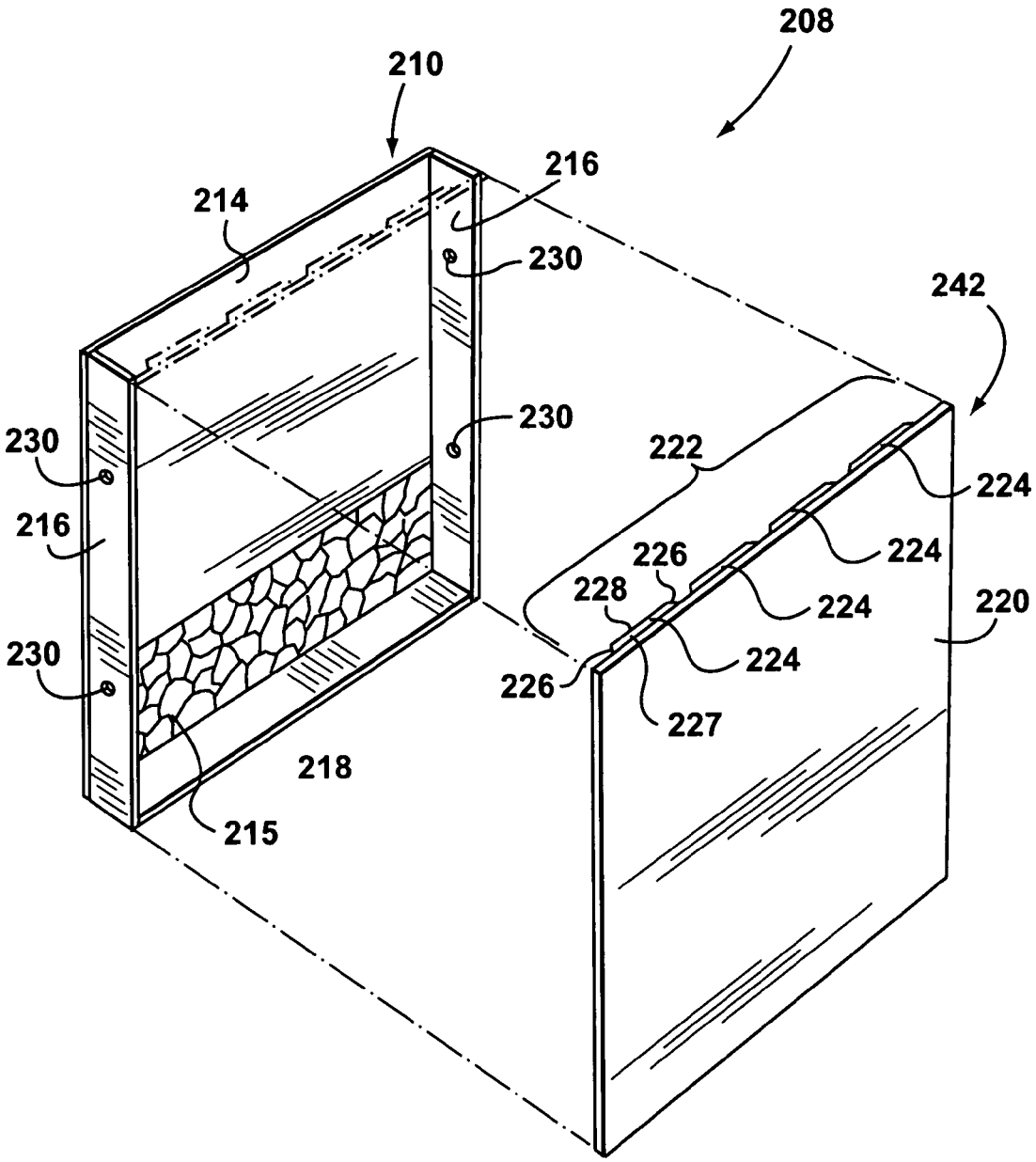
FIG. 17 is a schematic isometric view of a forming apparatus for forming concrete panels
Figure 18:
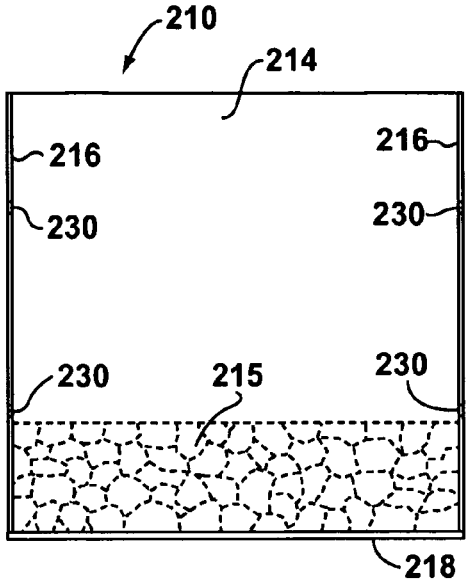
FIG. 18 is a schematic representation of an exterior form of the apparatus of FIG. 17, as viewed from the front.

As best seen in FIGS. 17 and 18, the exterior form 210 has an exterior base 214, with sidewalls 216 and a bottom panel 218 extending generally perpendicularly from the side and bottom edges of the base 214. All or a portion of the inner surface of the exterior base 214 can be provided with a surface pattern 215 to provide a desired architectural finish on the outer surface of the slab 12, of the panel 10, 50, 60.

Figure 19:
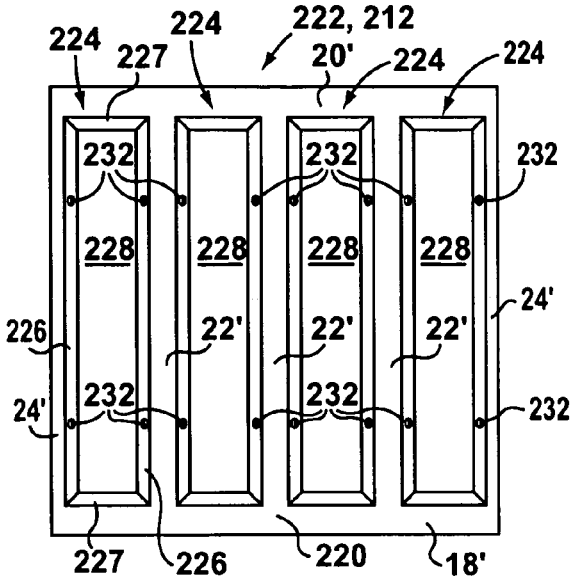
FIG. 19 is a schematic representation of an interior form of the apparatus of FIG. 17 as viewed from the back.

As best seen in FIGS. 17 and 19, the interior form 212 has an interior base 220 and an interior surface profile 222 extending from the inner surface of the interior base 220. The interior surface profile 222 can include subforms 224 with side faces 226, end faces 227, and front faces 228 extending between the sides 226 and end faces 227. The faces 226, 227 can be sloped at a draft angle, which is exaggerated in the Figures, to facilitate separation of the interior form 212 from the cast panel 10, 50, 60, as further described hereinafter.

To use the forming apparatus 202, the exterior and interior forms 210, 212 can be brought together so that the interior profile 222 is nested within the exterior form 210 and the periphery of the interior base 220 generally abuts the distal edges of the sidewalls 216 and bottom panel 218.

Figure 20:
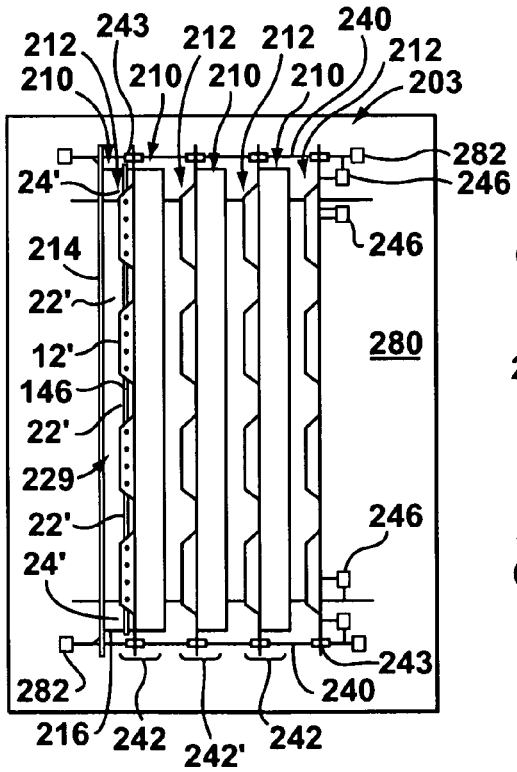
FIG. 20 is a schematic top view of a gang form apparatus comprising the forming apparatus of FIG. 17.
Figure 21:
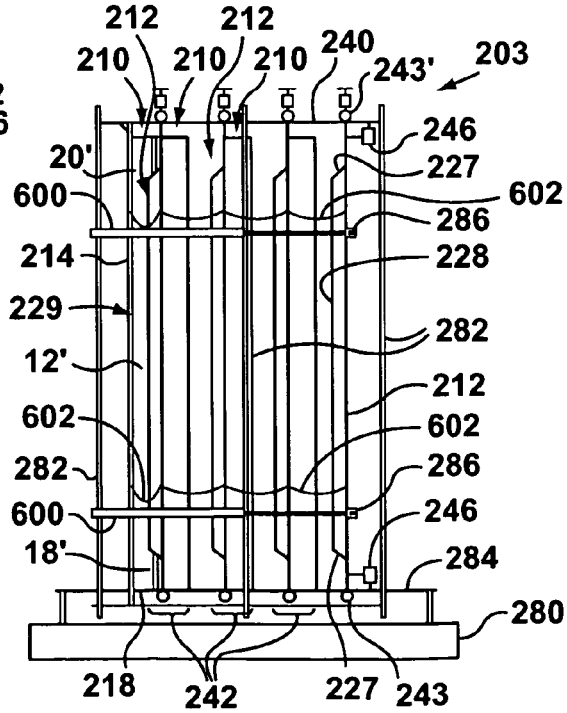
FIG. 21 is a schematic side view of the gang form of FIG. 19.

As best seen in FIGS. 20 and 21, this nested arrangement of the forms 210, 212 provides a generally enclosed cavity 229 that corresponds to the shape of the desired panel 10, 50, 60. The cavity 229 has a slab portion 12' that corresponds to the slab 12 of a panel 10, 50, 60. The cavity 229 also has interior rib and end rib portions 22', 24' corresponding to the ribs 22, 24. The cavity 229 has top and bottom beam portions 18' and 20' to form beams 18 and 20 in the panel 10, 50, 60. When using the apparatus 202, the top and bottom beam portions 18', 20' may be inverted, meaning that the top or the panel 10, 50, 60 is formed in the bottom of the forming apparatus 202. This may make it easier to form more complex shapes in the top of a panel 10, 50, 60 as will be described further below. For example, in the embodiment illustrated, the top beam portion 18' is positioned adjacent the bottom panel 218 of the form 210.

Concrete can be poured into the cavity 229 through the open top of the forming apparatus 202, opposite the bottom panel 218. The concrete can be vibrated to assist in removing air or flowing the concrete into recesses in the cavity 229, for example by a pencil vibrator or by vibrating forming apparatus 202. The upper surface of the concrete in the cavity 229 can be smoothed and leveled by scraping a board across the edges of the cavity 229. Once cured, the exterior and interior forms 210, 212 can be separated to release the concrete panel 10,50,60.

In the embodiment illustrated in FIGS. 20 and 21, the forming apparatus 202 comprises multiple exterior and interior forms 210, 212 sandwiched together to provide a gang form 203. The forms 210, 212 can be moved relative to each other along a horizontal track 240 to alternatively close and open each cavity 229 between the forms 210, 212, for pouring and releasing the concrete panels 10, 50, 60. Tracks 240 may be held by a frame 282 which in turn rests on or is secured to a foundation pad 280.

Figure 23:
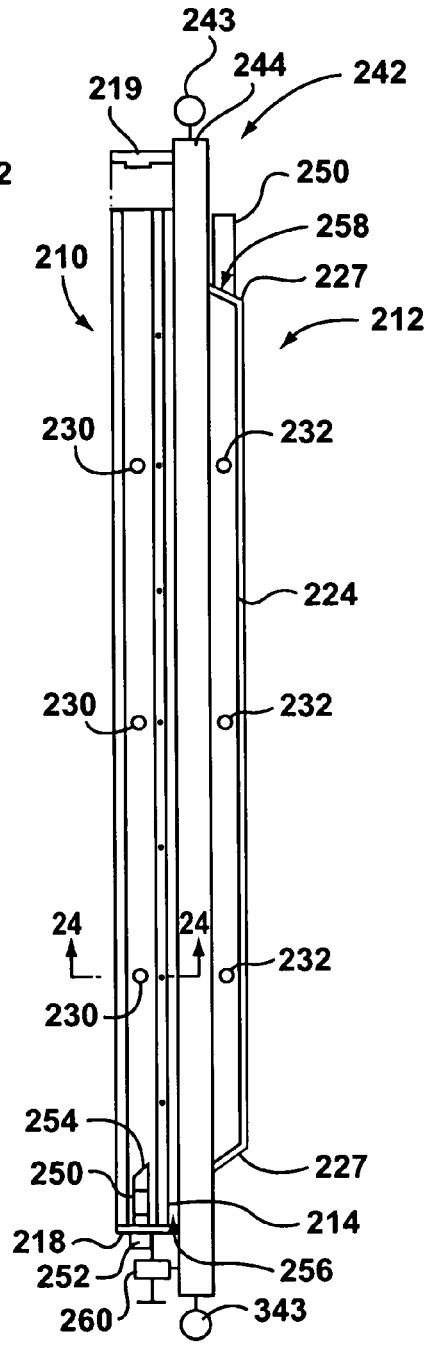

An endmost form, which may be either an exterior form 210 or an interior form 212, can be fixed relative to the track 240. In the embodiment illustrated in FIG. 20, the left end-most form is an exterior form 210 that is fixed in position relative to the track 240. The form adjacent the fixed exterior form 210 is an interior form 212 that is slidable on the track 240. This adjacent interior form 212 can be part of a forming board 242. Referring also now to FIG. 23, the forming board 242 has an interior form 212 on one side, and an exterior form 210 on the opposite side. The forming board 242 can have a core 244 positioned between the exterior and interior forms 210, 212 to facilitate attaching the forms 210, 212 together, and supporting them on the track 240. The core 244 functions as both the exterior base 214 and the interior base 220. Additional forming boards 242 can be provided along the track 240, each board 242 being oriented so that the interior and exterior forms 212, 210 of adjacent boards 242 can nest together to form a cavity 229 for pouring the panel 10, 50, 60. The forming boards 242 and/or the forms 210, 212 can be provided with slider elements 243, such as wheels, to facilitate moving the forms 210, 212 relative to each other along the track 240.

An opposing end-most form can be either an interior form 212 or exterior form 210, whichever is required to fit with the fixed end-most form. In the embodiment illustrated, the right end-most form is a single interior form 212 slidable on the track 240. Alternatively, the end-most forms can be forms 210, 212 attached to a forming board 242, with the forming board 242 presenting an unused, exposed exterior form 210, 212 facing outward from the apparatus 203.

To use the gang form 203 illustrated, the first forming board 242 adjacent the fixed exterior form 210 is slid along the track 240 so that the interior form 212 nests inside the fixed exterior form 210. The remaining forming boards 242 and the right end-most interior form 212 are similarly moved into position along the track 240 to form a series of cavities 229.

Once all the forms 210, 212 have been moved into the nested positions, jacks 246 or hydraulic rams can be engaged to exert a horizontal closing force on all the form elements, pressing the forms 210, 212 together. Jacks 246 can be attached to tracks 240 or to a jack rail 284. Jacks 246 can slide along rail 240 or jack rail 84 as the forms 210, 212 are moved but can also be locked in position relative to rail 240 or jack rail 284 and adjusted to push against the end most movable form when the gang form 203 is closed. The jacks 246 help to ensure that forms 210, 212 are properly positioned relative to each other before concrete is poured into the cavities, and to bear against a separating force exerted by the poured concrete. After the jacks 246 have been engaged, the concrete can be poured into the cavities 229.

When the concrete has cured, the jacks 246 can be released. The forms 210, 212 can be moved apart from each other along the track 240. Forms 210, 212 can be moved, for example, by activating a machine, for example a machine having a manual or powered extendable or retractable level or arm, such as a hydraulic cylinder 600. Multiple hydraulic cylinders 600 may be used, for example, four hydraulic cylinders 600 located to provide an upper and lower hydraulic cylinder 600 on each side of the form 203. Hydraulic cylinder 600 has one end fixed in relation to frame 282. The other end of hydraulic cylinder 600 may bear on the last movable form 210, 212, for example through a bar 286, to move the form 210, 212 towards an open position when hydraulic cylinder 600 is extended or retracted. Flexible tension members, for example cables or chains 602, have a length corresponding to the distance between forms 210, 212 or forming boards 244 when gang form 203 is open and are connected between pairs of adjacent forms 210, 212 or forming boards 242, as end most form 212 is moved, chains 602 tighten and pull on successive interior forming boards 242 until all movable forms 210, 212 or forming boards 242 are separated. The same machine, operated in reverse, can be used to move the forms 210, 212 or forming boards 242 into a nested position. For example, hydraulic cylinders 600 may be retracted to pull the last movable form 212 inwards which in turn causes the interior or forming boards 242 to move inwards as the outmost form 212 pushes on them. Hydraulic cylinders 600 may be used to hold the forms 210, 212 together during forming in separate dedicated jacks 246 or rams may be used as described above. After forming, the concrete panels 10, 50, 60 can be removed from the gang form 203, for example by lifting them by a crane.

The forming apparatus 202 can be adapted to provide additional features of the panels 10, 50, 60. For example, horizontally aligned holes 230 can be provided in the sidewalls 216 of the exterior form 210, and holes 232 can be provided through the sides 226 of the subforms 224 of the interior form 212. When the forms 210 and 212 are nested together for casting, rods 146 can be inserted horizontally through the aligned holes 230 and 232. After the concrete has cured, the rods 146 can be removed, leaving the holes 32 in the ribs 22, 24 of the panel 10, 50, 60. Engagement of the jacks 246 can facilitate insertion and removal of the rods 146 by taking up any transverse load that may otherwise urge the holes 230 and 232 out of alignment, which could cause binding of the rods 146. Optionally or additionally, rods 146 may be elastomeric such that pulling on one end of them causes their cross section to decrease to aid in removing them. Further optionally, rods 146 may comprise a spiral wound sheet material. In that case, twisting or compressing the ends of rods 146 causes their diameter to decrease to aid in striping. Further optionally, a rod stripping machine, for example, comprising a frame bearing against the forming apparatus, a free wheel bearing against one side of the rod and a driven wheel bearing against the other side of the rod 146 may be used to pull rod 146 out.

The forms 210, 212 can also be adapted to provide the vertical holes 38 in the top and bottom beams 18, 20 of the panels 10, 50, 60. As best seen in FIG. 23, a short length of pipe 250 can be positioned on a locating pin 252 extending upward from the bottom panel 218 of the exterior form 210. The locating pin 252 can be, for example, but not limited to, the threaded end of a bolt. The pipe 250 can be a length of steel or plastic tubing. The upper end 254 of the pipe 250 can be slightly inclined to match the bottom end surface 227 of the subform 224 of a nested interior form 212. The pipe 250 can be cast into, and remain with, the finished panel 10, 50, 60. The inner diameter of the pipe 250 can provide the vertical hole 38 in the finished panel 10, 50, 60. Since the finished panels 10, 50, 60 are removed from the forming apparatus 202 by lifting them up with a crane, the locator 252 does not interfere with removal of the cast panel 10, 50, 60, from the exterior form 210.

Alternatively, the bottom panel 218 of the exterior form 210 can be movable relative to the base 214, so that it can be lowered away from the lower edge 256 of the base 214. A jack 260 can engage the bottom panel 218 to move the bottom panel 218 between an upper "casting" position and a lower "release" position. In the release position, the bottom panel 218 and pin 252 are moved clear of the panel 10, 50, 60 so that the forming board 242 can be moved panel 10, 50, 60 can easily be removed from the form 210.

To provide the vertical holes 38 in the bottom beam 20 of the panel 10, 50, 60, a second length of pipe 250 can be positioned on a locator 258 extending from the upper surface 227 of the subform 224 of the interior form 212. Alternatively, second lengths of pipe 250, extending down to the upper surface of subforms 224 from above, can be held in a jig from above the cavities 229. Alternate vertical holes 38 can be made in beams 18 after forming.

Figure 22:
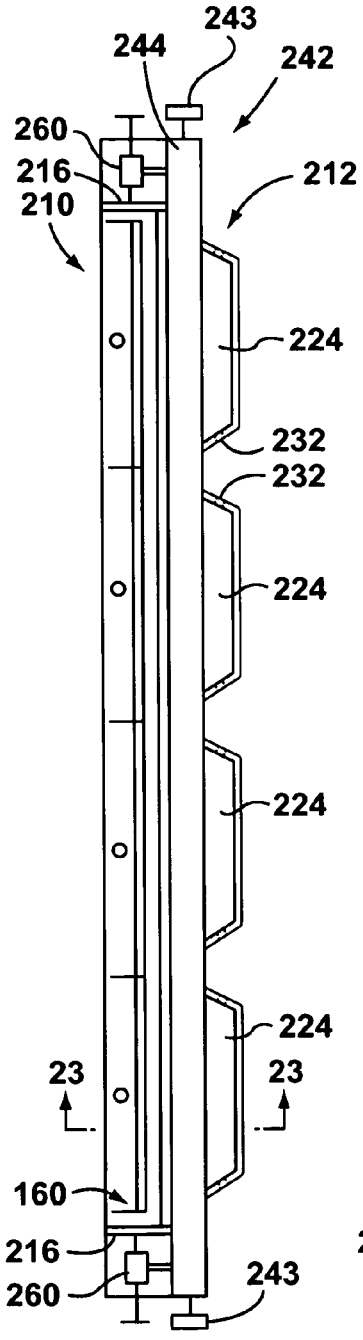
FIGS. 22 and 23 are top and side sectioned views of a forming board for use in the gang form of FIGS. 20 and 21.
Figure 24:
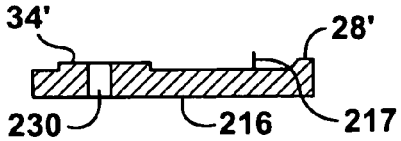
FIG. 24 is a cross section of an end plate of a forming board of FIGS. 22 and 23.

As best seen in FIGS. 22 and 24, the forming apparatus 202 can also be adapted to provide the channels 34, 36 and rabbets 26, 28 in the panels 10, 50, 60. For example, the sidewalls 216 of the exterior form 210 can have inwardly protruding strips 34' and 28' to produce the channel 34 and rabbet 28 in the panel 10, 50, 60.

Similar to the bottom panel 218, the sidewalls 216 can be movable relative to the base 214, and jacks 260 can engage the sidewalls 216 to move the sidewalls 216 between inward "casting" positions and outward "release" positions (FIG. 22). Even the embodiments where additional features such as the vertical holes 38, the channels 34, 36, and the rabbets 26, 28 are not provided by the forming apparatus 202, movable sidewalls 216 and bottom panel 218 and jacks 260 can be provided to facilitate release of the panel 10, 50, 60.

To provide additional features in the uppermost surface of the bottom beam 20 of the panel 10, 50, 60, a top panel 219 (FIG. 23) having a corresponding surface profile can be pressed into the poured concrete at the upper end of the exterior form 210, opposite the bottom panel 218 before the concrete cures.

Figure 25:
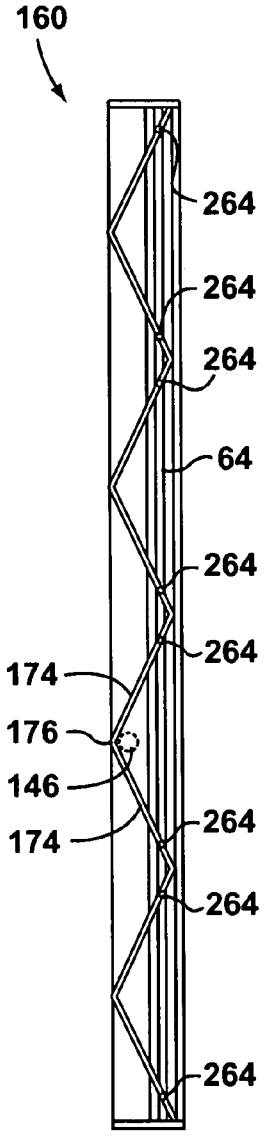
FIG. 25 is a side view of a reinforcing basket with insulation added for an insulated panel.

As best seen in FIGS. 22 and 25, to provide reinforcement for the panel 10, 50, 60, the reinforcement basket 160 can be inserted between the forms 210, 212 prior to nesting them together for casting. Optionally, sacrificial hangers (not shown) can extend from an inner surface of the exterior or interior form 210, 212 to position and support the basket 160 on the form 210, 212 prior to nesting them together. Alternatively or additionally, the basket 160 can be positioned in the exterior form 210, supported on the bottom panel 216, optionally on a sacrificial spacer. The forms 210, 212 can then be nested together. The basket 160 can then be lifted from above to the desired vertical position, and held in place during pouring of the concrete into the cavity 229. The basket 160 can be supported in the proper vertical position by the horizontal rods 146 used to form the holes 32 in the panels 10, 50, 60 or by hangers above the cavity 229 extending down into the cavity 229. For example, once the basket 160 has been lifted, the rods 146 can pass through the crook of the intersections 176 of the diagonals 174 of the basket 160 to bear the weight of the basket 160 within the cavity 229.

The basket 160 can be provided with insulation 64 for providing space between the concrete of the slab 12 and the ribs, beams 22, 24, 18, 20 of the insulated panel 60. The insulation 64 can be in the form of a sheet that is secured within the basket 160, for example, to the diagonals 174 by ties 264. The sidewalls 216 can also have pins 217 to further support the insulation 64. The sheet of insulation 64 can extend across the entire width and height of the exterior form 210, and can help to position and support the basket within the form 210. Concrete can be poured on either side of the insulation, providing the cavity 229 with the slab portion 12' and the beam, rib portions 18', 20', 22', 24' on opposite sides of the insulation 64 separated by a thermal break or air gap 62. In the cured panel 60, the ribs 18, 20, 22, 24 are secured to the slab 12 by the diagonals 264 that extend through the insulation 64. If desired, the insulation can be cut and or trimmed between the ribs 22, 24 so that the slab portion 12' is completely separated from all other parts of the panel 10, 50, 60.

Referring now to FIGS. 26-33, various alternative embodiments of the forms 210, 212 for providing panels 10, 50, 60 with particular features will be described.

Figure 28:
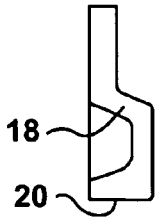
FIGS. 26 to 33 are schematic representations of alternate embodiments of the exterior and interior forms of FIGS. 18 and 19.
Figure 27:
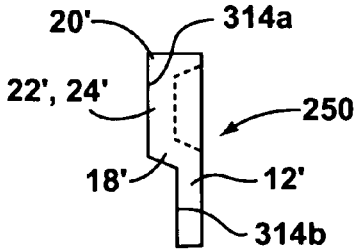
Figure 26:
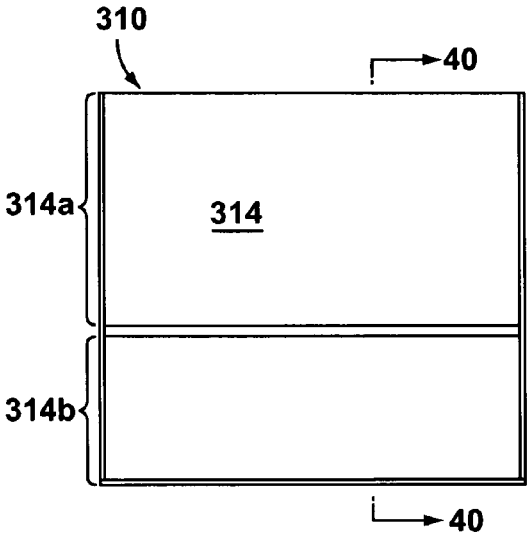
Figure 29:
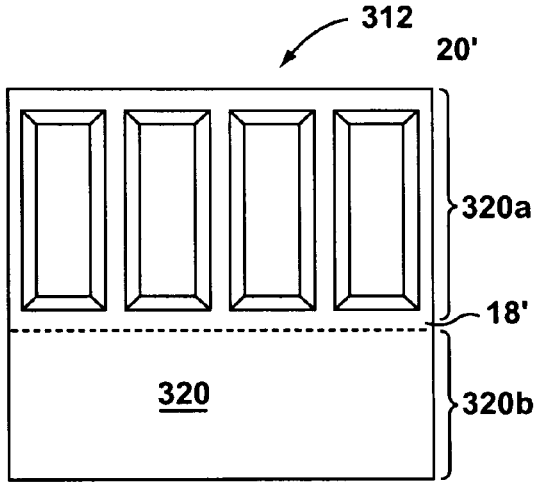

The exterior and interior forms 310, 312 (FIGS. 26-29) provide a panel 10, 50, 60 having ribs 22, 24 along only a portion of the height of the panel 10, 50, 60. The exterior form 310 has a base 314 with upper and lower portions **314*a* and 314*b*. The lower portion 314*b* is set forward relative to the upper portion 314*a*. The base of 320 of the interior form 312 is also divided into corresponding upper and lower portions 320*a* and 320*b*. When nested together, the forms 310, 312 provide a cavity 329 with a bottom beam portion 20' at its upper end, a top beam portion 18' at an intermediate position along the height of the cavity 329, a slab portion 12' that extends the full height of the cavity 329 (FIG. 27). This can form a panel 10, 50, 60 with a thin, slab-only portion at its upper end, against which bricks or other decorative stonework can be positioned (FIG. 28**).

Figure 30:
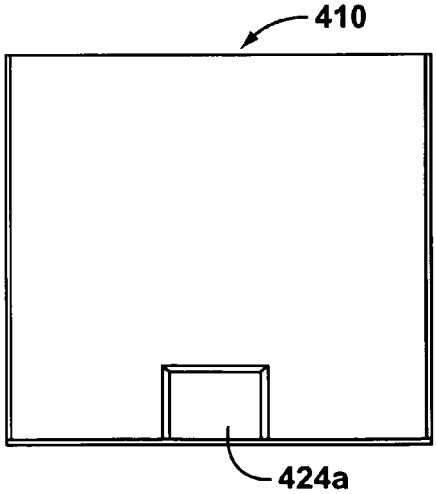
Figure 31:
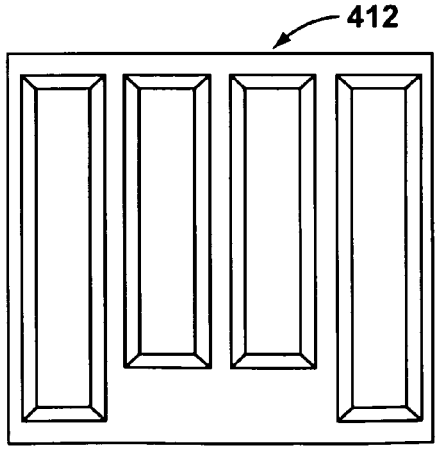

Referring now to FIGS. 30 and 31, the exterior and interior forms 410 and 412 can provide panel 10, 50, 60 with a window cut-out. This exterior form 410 has a sub form **424*a*, that nests with the interior form 412** and provides a window cut-out.

Figure 32:
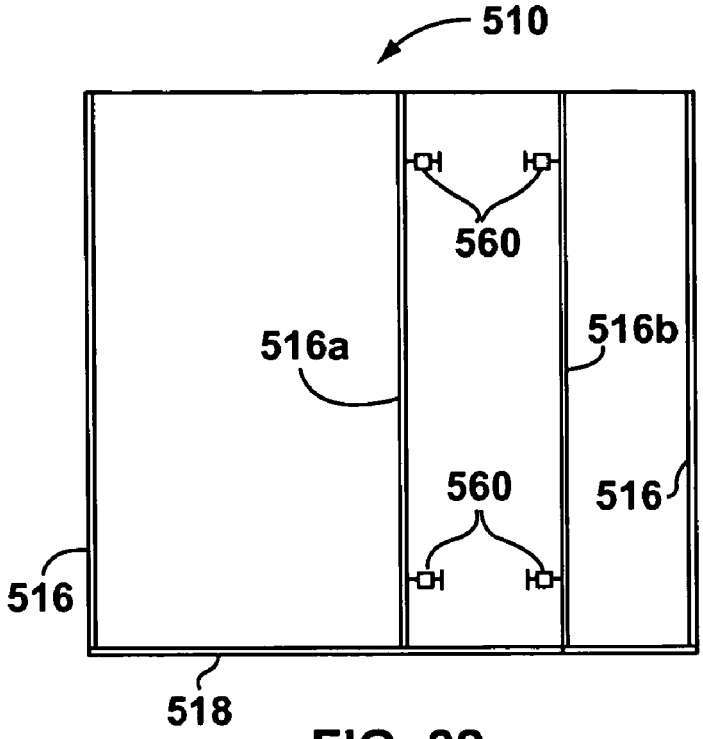
Figure 33:
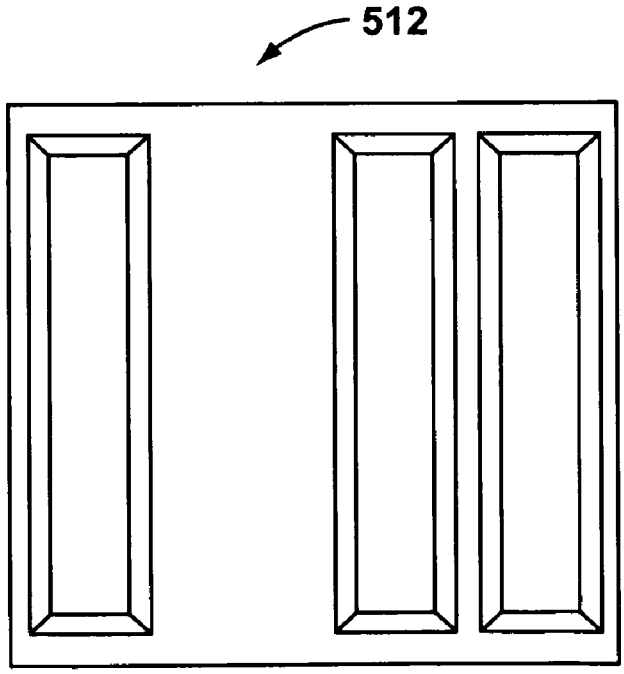

Referring now to FIGS. 32 and 33, the exterior and interior forms 510 and 512 can provide two panels 10, 50, 60 of different widths, each width less than the width of a full panel 10, 50, 60. The exterior form 510 has a pair of intermediate sidewalls **516*a* positioned parallel to, and spaced between, the sidewalls 516. The intermediate sidewalls 516 can be moved laterally inward and outward, as by jacks 560, between casting and release positions to facilitate removal of the cast panels 10, 50, 60 from the form 510**.

The gang form 203 can have forming boards 242 with any of the exterior and interior forms 310, 312, or 410, 412, or 510, 512 in place of the forms 210, 210. Furthermore, the forming boards 242 need not be identical, but rather, a single gang form apparatus 203 can have a variety of sets of forms to produce panels 10, 50, 60 of different configurations in a single pour/cure cycle. As well, the forming boards 242 can be provided in two types in which a first board type has two external forms 210, 310, 410, 510, one mounted on either side of the core 244, and a second board type has two internal forms 212, 312, 412, 512, one mounted on either side of the core 244. The two board types can then be provided alternately along the length of the track 240.

Figure 37:
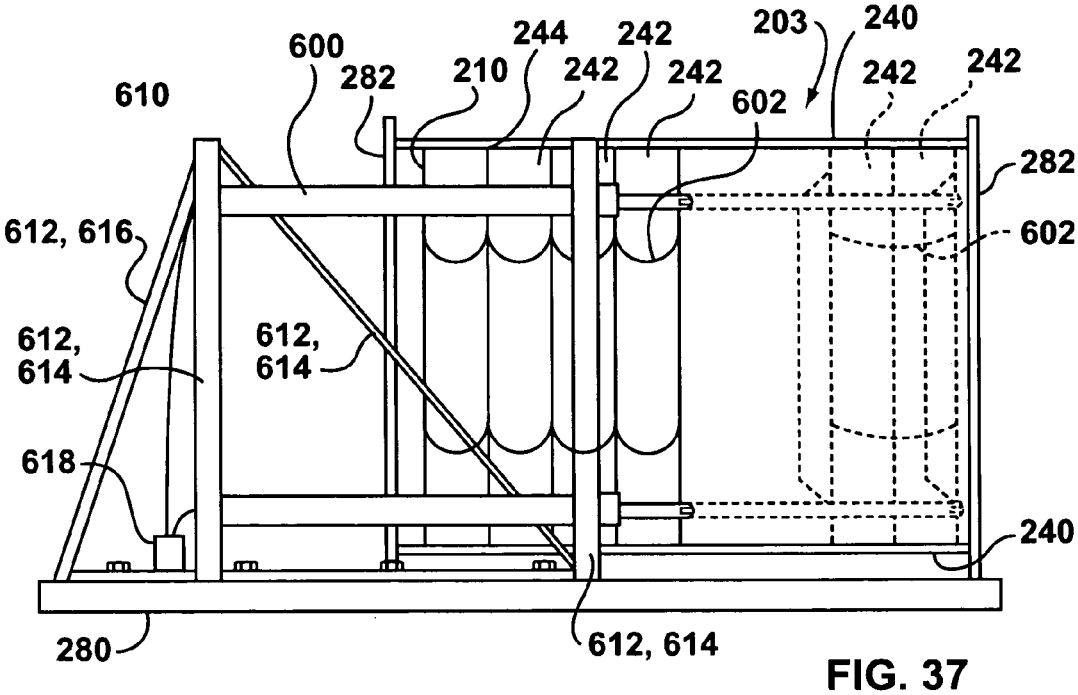
FIG. 37 is a side view of another forming apparatus.
Figure 38:
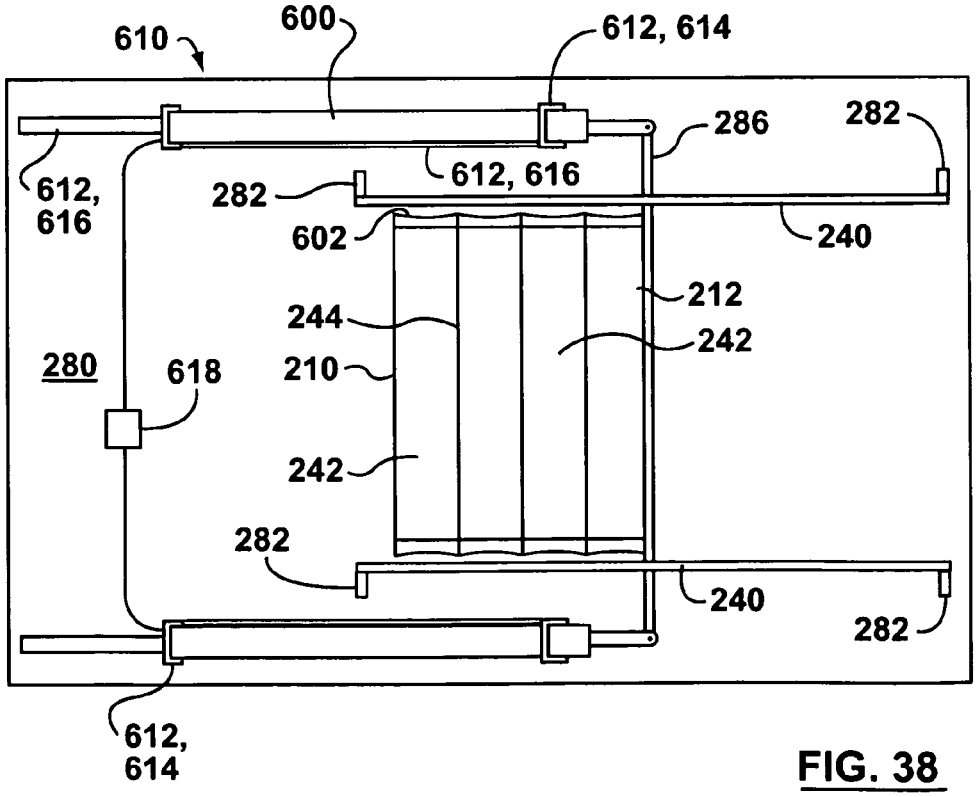
FIG. 38 is a plan view of part of the forming apparatus of FIG. 37.

FIGS. 37 and 38 show an alternate device 610 for moving forms 212, 214 or forming boards 242. The alternate device 610 differs from FIG. 21 in that the hydraulic cylinders 600 are supported in a separate driving frame 612 rather than on forming apparatus frame 282. Driving frame 612 comprises vertical channels 64 and braces 616. Bodies of hydraulic cylinder 600 may be attached to one or both vertical channels 614 and are powered by common pump and controller 618. Driving frame 612 is located generally outside of forming apparatus frame 282. Bore 286 extends beyond forming apparatus frame 282 to engage the drive ends of hydraulic cylinders 600.

Figure 34:
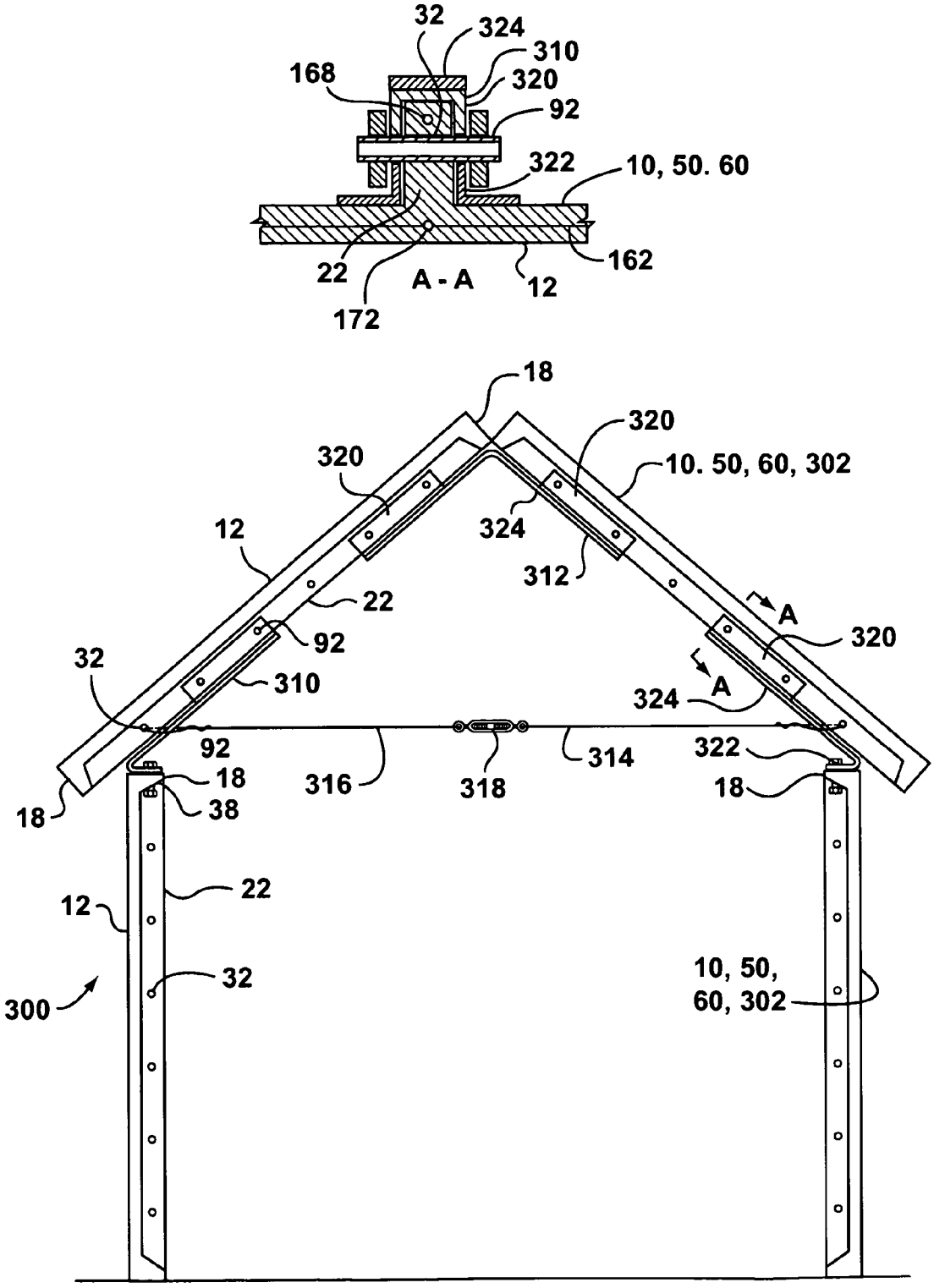
FIG. 34 is a cross-section of a house made with concrete wall and roof panels.

Referring now to FIG. 34, the panels 10, 50, 60 can be used to form the walls 302 or roof 304 or both of a building 300.

A first connector 310 can be provided for joining two panels 10, 50, 60 together by connecting the rib 22 of one panel 10, 50, 60 to the beam 18 of another panel 10, 50, 60. A second connector 312 can be provided for joining together two panels 10, 50, 60 by their respective ribs 22. In the building 300 shown, first connectors 310 connect the upper ends of the walls 302 to the roof 304. Cross-members, such as joists for a floor, may be provided between the upper ends of opposed walls between the first connectors 310 and the beams 18 of the walls 302. In this case, bottom ends of first connectors 310 may optionally be bolted to the floor deck rather than, or in addition, to walls 302. Alternately, a vaulted ceiling may be made as shown without a floor deck by providing collar ties 314 between opposed roof panels 304 or wall panels 302. Collar ties 314 may comprise, for example, lengths of cable 316 connected at one end to a panel 10, 50, 60 through a hole 32, 38 and at the other end to a turnbuckle 318. The roof 304 is constructed of panels 10, 50, 60 having respective beams 18 adjacent each other. The roof 304 panels 10, 50, 60 are connected to each other by second connectors 312. First connectors 310 and second connectors 312 may be bolted to holes 32, 38 in panels 10, 50, 60 by pipe bolts 92 or other fasteners.

Section A-A of FIG. 34 is a cross section through a part of a first connector 310. The cross section of second connector 312 is the same at both of its ends. The first connector 310 comprises a channel 320. The channel 320 is configured to fit over a rib 22 and also has flanges which may bear against slab 12. Optionally, a channel of other shapes, for example a "C" or "L" shape channel, may be used. Channel 320 has holes 322 positioned to allow channel 320 to be fastened to holes 32 of ribs 22, for example by a pipe bolt 92. Channel 320 may be metal, for example steel or aluminum. A strap 324, optionally of metal, is attached, for example by welding, to channel 320. Strap 324 extends beyond channel 320 to provide a connection between a panel 10, 50, 60 attached to channel 320 and another structure. In the case of a second connector 312, the other structure is a second panel 10, 50, 60 attached to the strap 324 through a second channel 320. In the case of a first connector 320, strap 324 has a hole 322 in its end adapted to allow strap 324 to be attached to a panel 10, 50, 60 through a hole 38 in a beam 18, for example by a pipe bolt 92. Strap 324 may be bent as required to accommodate angles between a panel 10, 50, 60 and another structure, for example a second panel 10, 50, 60. Gussets, not shown, may be attached, for example welded, to strap 324 to reinforce a bent portion of strap 324.

Figure 35:
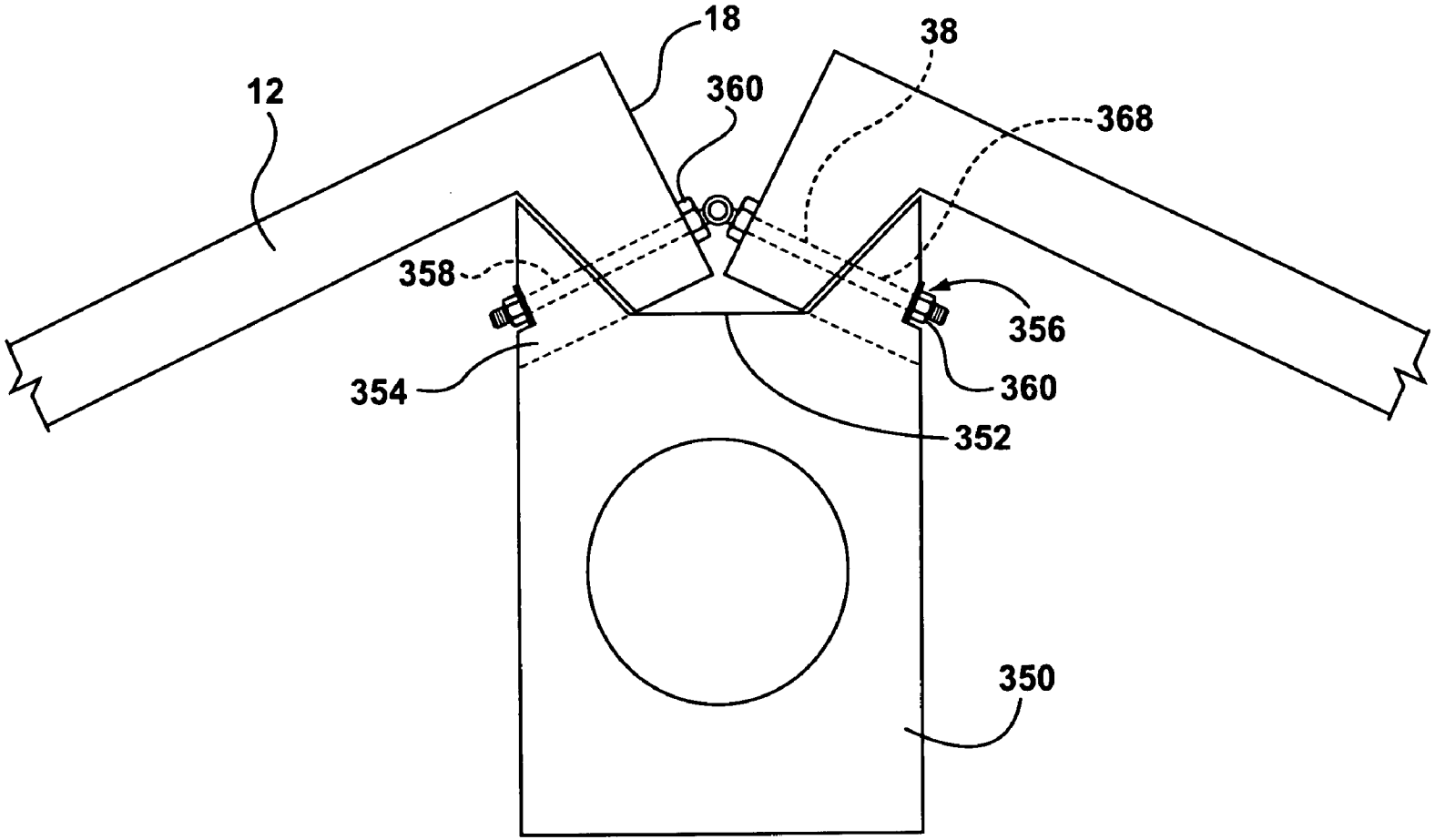
FIG. 35 is an end view of two concrete roof panels supported by a ridge beam.

FIG. 35 shows an alternate means for connecting two roof 304 panels 10, 50, 60. A ridge beam 350 may be supported, for example, by end walls or posts of a structure. The ridge beam 350 may be a reinforced concrete structure having an upper surface 352 contoured to support the beams 18 of roof 304 panels 10, 50, 60. A region 354 of the upper surface 352 of the ridge beam 350 which would contact ribs 22, 24 is removed in the area of ribs 22, 24. Beams 18 may be fastened to ridge beam 350, for example by an angle bolt 356 passing through holes 38 in beams 18 and holes 368 in ridge beam 350.

Angle bolt 356 may have a pair of threaded legs 358 passing through ridge beam 350 and beams 18. The legs 358 are attached to each other at one end, for example by welding or, as shown, by passing a bolt through a ring on the end of each leg 358. A nut 360 is threaded onto the other end of leg 358 and bears against ridge beam 350. Optionally, nuts 360 may also be threaded further up on legs 358 and bear on the beams 18. A pair of ordinary bolts may be used in place of angle bolt 356.

Figure 36:
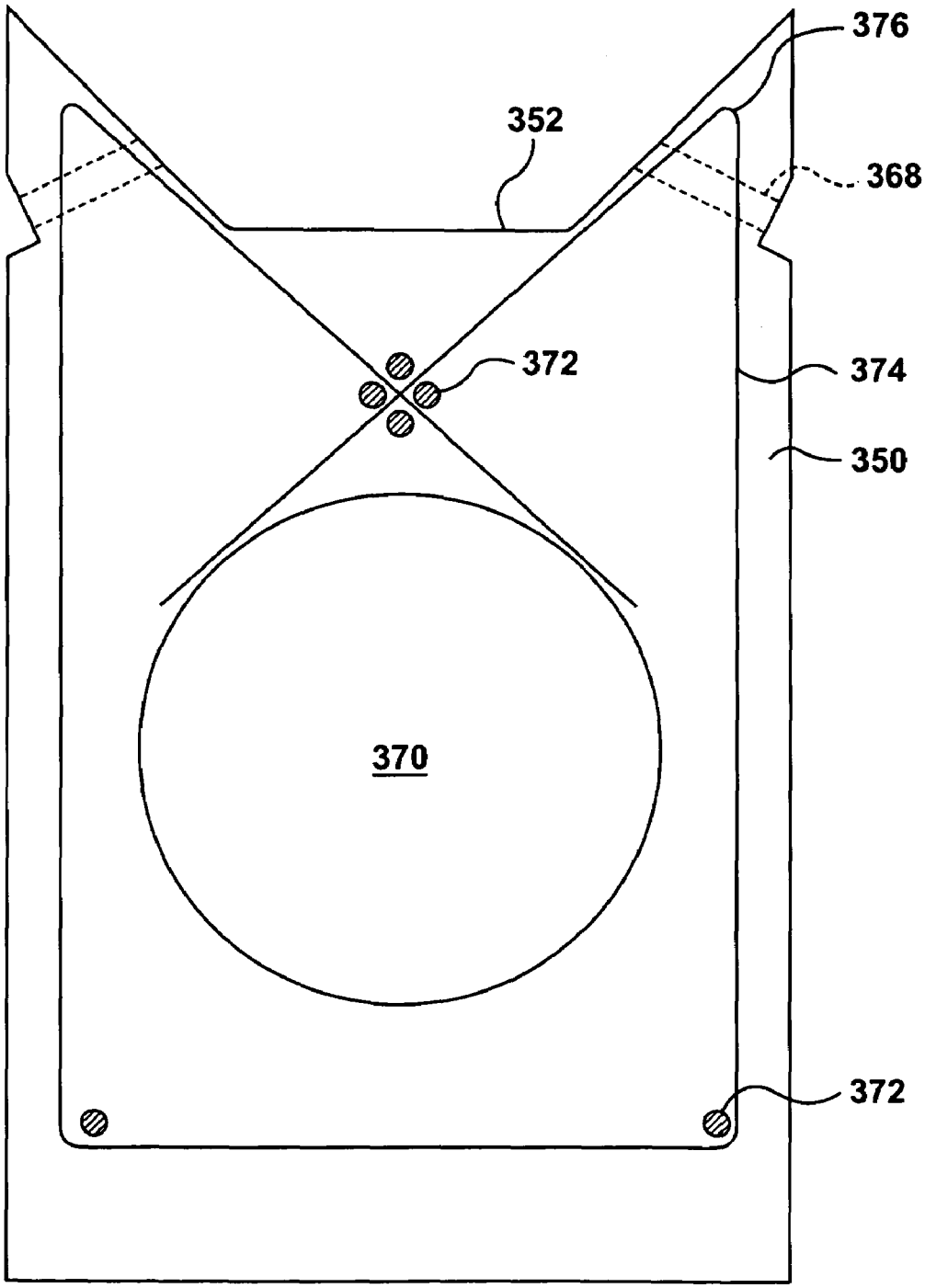
FIG. 36 is a cross-section of the ridge beam of FIG. 35.

FIG. 36 shows a cross section of ridge beam 350. Ridge beam 350 has a hollow centre 370 formed, for example, by casting a cardboard tube into ridge beam 350. Longitudinal reinforcing bars 372 are placed along the length of ridge beam 350. Transverse reinforcing bars 374 are spaced along the length of the ridge beam 350. Transverse reinforcing bars 374 may be placed near every hole 368. Optionally, upper parts of reinforcing bars 374 may also be angled such that a portion of transverse reinforcing bar 374 running up the side of ridge beam 350 passes on one side of hole 374 to an apex 376 and angles partially longitudinally and partially inwards such that another portion of transverse reinforcing bar 374 passes on the other side of hole 374 on its way towards the interior of ridge beam 350.

I claim:

1. A forming apparatus for forming a poured concrete panel, the apparatus comprising:

a) a first form having a generally vertical planar base; and a bottom panel and sidewalls attached to and extending generally perpendicularly from the base;

b) a second form having a generally vertical planar base adapted to be nested with the first form, the forms providing a generally enclosed cavity when so nested; and, c) a track to which the forms are secured, at least one of the forms being slidable along the track relative to the other for moving the forms between nested and released positions, wherein the bottom panel or a sidewall is movable relative to the base of the first form between casting and released positions while the movable bottom panel or sidewall remains attached to the first form.

2. The apparatus of claim 1 further comprising jacks for moving the bottom panel or a sidewall relative to the base of the first form between the casting and release positions.

3. A forming apparatus for forming a poured concrete panel, the apparatus comprising, a) a first form having a generally vertical planar base; and a bottom panel and sidewalls attached to and extending generally perpendicularly from the base;

b) a second form having a generally vertical planar base adapted to be nested with the first form, the forms providing a generally enclosed cavity when so nested; and c) a track to which the forms are secured at least one of the forms being slidable along the trace relative to the other for moving the forms between nested and released positions; and d) a machine adapted to move an end most form along the track to the released position and flexible tension members connected to pairs of adjacent intermediate forms such that the end most form pulls the intermediate forms to the released position.

4. A forming apparatus for forming a poured concrete panel, the apparatus comprising, a) a first form having a generally vertical planar base; and a bottom panel and sidewalls attached to and extending generally perpendicularly from the base;

b) a second form having a generally vertical planar base adapted to be nested with the first form, the forms providing a generally enclosed cavity when so nested; and c) a track to which the forms are secured at least one of the forms being slidable along the trace relative to the other for moving the forms between nested and released positions, wherein one of the first and second forms has a plurality of space-filling sub-forms extending from the base of one of the forms such that when the first and second forms are nested they define a cavity having a slab, a pair of end ribs, and upper and lower beams, the ribs and beams being generally perpendicular to the slab and oriented vertically in an installed panel, the beams being generally perpendicular to the slab and oriented horizontally in an installed panel.

* * * * *